US005468955A

United States Patent [19]

Chen et al.

[11] Patent Number: 5,468,955

[45] Date of Patent: Nov. 21, 1995

[54] NEUTRAL BEAM APPARATUS FOR IN-SITU PRODUCTION OF REACTANTS AND KINETIC ENERGY TRANSFER

[75] Inventors: Lee Chen, Austin, Tex.; Dragan Podlesnik, San Jose, Calif.; Akihisa Sekiguchi, Tarrytown, N.Y.

[73] Assignee: International Business Machines Corporation, Armonk, N.Y.

[21] Appl. No.: 359,974

[22] Filed: Dec. 20, 1994

[51] Int. Cl.[6] ..... H05H 3/02

[52] U.S. Cl. ..... 250/251; 315/111.81

[58] Field of Search ..... 250/251; 315/111.81

[56] References Cited

U.S. PATENT DOCUMENTS

| | | | |
|---|---|---|---|
| 4,401,054 | 8/1983 | Matsuo et al. | 118/723 |
| 4,419,203 | 12/1983 | Harper et al. | 250/251 |
| 4,574,179 | 3/1986 | Masuzawa et al. | 219/121 PG |
| 4,713,542 | 12/1987 | Campana | 250/251 |
| 4,782,235 | 11/1988 | Lejeune et al. | 315/111.81 |
| 4,831,963 | 5/1989 | Saito et al. | 118/723 |
| 4,867,859 | 9/1989 | Harada et al. | 204/298 |
| 4,918,033 | 4/1990 | Bartha et al. | 437/245 |
| 4,960,073 | 10/1990 | Suzuki et al. | 118/723 |
| 5,122,251 | 6/1992 | Campbell et al. | 204/288.06 |
| 5,125,358 | 6/1992 | Ueda et al. | 118/723 |
| 5,133,825 | 7/1992 | Hakamata et al. | 156/245 |
| 5,216,241 | 6/1993 | Hatakeyama et al. | 250/251 |

FOREIGN PATENT DOCUMENTS

| | | | |
|---|---|---|---|
| 3197585 | 8/1986 | Japan | 118/723 |
| 61-256639 | 11/1986 | Japan | 118/723 |
| 61-284918 | 12/1986 | Japan . | |
| 0209109 | 1/1987 | Japan | 118/723 |
| 62-120477 | 6/1987 | Japan | 118/723 |
| 2228471 | 9/1990 | Japan | 118/723 |
| 2194966A | 8/1986 | United Kingdom | 118/723 |

*Primary Examiner*—Jack I. Berman

*Attorney, Agent, or Firm*—Whitham, Curtis, Whitham & McGinn; Harold Huberfeld

[57] ABSTRACT

The discovery that a location exists in a plasma sheath surrounding a plasma near a plasma confining surface where recombination of ions and electrons is favored due to Coulombic interaction is exploited to provide filtration of flux components and enhance neutralization of ions extracted from the plasma. By engineering of the dimensions of apertures in an apertured plate in accordance with plasma conditions and differential pumping, a high quality, high flux neutral beam can be developed wherein the particle energies may be scalable from very low levels below that which causes crystal lattice damage in semiconductor materials to very high levels. The production of a beam of neutral beam of good directivity and well-defined geometry is further exploited to provide predictability in plasma chemistry reactions and to form reactants in-situ for semiconductor processing. In-situ production of minute quantities of hydrofluoric acid for interface tailoring provides a "dry", high vacuum compatible alternative to wet etch processes.

20 Claims, 11 Drawing Sheets

| n | $V_p$ | sheath thickness |
|---|---|---|
| $10^9$ | 30 | 2.5 mm |
| | 40 | 3.1 mm |
| | 50 | 3.7 mm |
| | 60 | 4.2 mm |
| $10^{10}$ | 30 | 0.8 mm |
| | 40 | 1.0 mm |
| | 60 | 1.3 mm |
| $10^{11}$ | 30 | .25 mm |
| | 40 | .31 mm |
| | 60 | .40 mm |

1 = coil's first turn, into page (high voltage side, to match box)
2 = coil's second turn, into page
3 = coil's third turn, into page
4 = coil's fourth turn, into page (low voltage side, e.g., to ground)

e.g., coil is cut from copper sheet

MULTI-STAGE-PLASMA FAST BEAM SOURCE

NEUTRAL BEAM APPARATUS FOR IN-SITU PRODUCTION OF REACTANTS AND KINETIC ENERGY TRANSFER

BACKGROUND OF THE INVENTION

1. Field of the Invention

The present invention generally relates to the production of a beam of particles and, more particularly, to the production of a beam of neutral particles having kinetic energies which are readily controllable over a wide range and of substantially arbitrary chemistry, especially suitable for the in-situ production of minute amounts of chemicals during semiconductor processing.

2. Description of the Prior Art

Devices using beams of charged particles have achieved wide utility in many well-known electronic devices. For example, the cathode-ray tube is a major component of television sets and sensitive measurement devices such as oscilloscopes which have been known for many years. The ease and speed with which a beam of electrons, each having the same small mass and the same charge, can be manipulated has also led to numerous other electronic devices such as electron beam commutators. For the same reason, the use of a deflectable electron beam has become of interest for direct writing in high resolution lithography processes and other semiconductor manufacturing applications. Accordingly, the field of electron beam optics has become highly developed and is capable of producing positional accuracy and resolution to a small fraction of a micron at the present state of the art.

Devices which produce beams of positively charged ions are also known in semiconductor manufacturing. Such devices are typically used for directing ions against a surface of a semiconductor structure (e.g. a wafer which may or may not have layers or other structures formed thereon) for purposes of implanting, depositing or etching a material. Ion beams are typically somewhat more difficult to manipulate than electron beams since the increased mass of ions of ions (relative to electrons) requires much higher levels of energy to manipulate and direct the beam (e.g. to extract from a plasma source, accelerate, deflect, focus, etc.). At the same time, the crystal structure of the semiconductor material is easily damaged even at relatively low velocities of relatively massive particles. For example, it is usually necessary to anneal a semiconductor material after an ion implantation operation to restore the crystal lattice structure and repair damage thereto caused by the kinetic energy of the particles used in the implantation process.

However, at low velocities, the mutual repulsion between like-charged particles is sufficient to cause substantial expansion of the beam and the directivity of the particles is easily lost since, at comparable energies, ion velocity is far less than electron velocities due to the much greater mass of ions. Therefore, there is a relatively small "window" of conditions where an ion beam can be maintained to perform a desired process on a semiconductor material. Therefore, ion beam processes have generally been limited to the use of a broad, unfocussed and relatively diffuse ion beam with relatively low ion flux.

Because of these limitations on ion beam devices imposed by the materials on which processes are to be performed, some highly complex and sophisticated devices have been developed in order to assist in ion confinement to a beam and to remove energy from the beam immediately prior to the target. U. S. Pat. Nos. 5,196,706 and 5,206,516 to John H. Keller et al. and assigned to the assignee of the present invention are exemplary of the complexity and sophistication of design which is required to expand the conditions within the ion beam, such as increased ion flux, in a manner consistent with low damage to the semiconductor material confinement of ions in a beam and to avoid destruction of the semiconductor lattice structure. U.S. Pat. No. 5,196,706, for example, uses a multi-element deceleration lens to converge the ion beam and then remove energy from it immediately adjacent to the target so that rapid expansion of the low-beam of low energy ions is tolerable even when the energy is reduced as low as 25 eV. U. S. Pat. No. 5,206,516, teaches maintaining of a plasma discharge over a substantial portion of the length of the ion beam to maintain the beam in a substantially space-charge neutralized condition to counteract mutual repulsion between ions and limit expansion of the ion beam.

The use of charged particles, itself, produces problems in the manufacture of semiconductor devices. As devices have become smaller and integration densities increased, breakdown voltages of insulation and isolation structures therein have, in many instances, been markedly reduced, often to much less than ten volts. For example, some integrated circuit device designs call for insulators of sub-micron thicknesses. At the same time, reduction of size of structures reduces the capacitance value of the insulative or isolation structures and relatively fewer charged particles are required to develop a electric field sufficient to break down insulator or isolation structures. Therefore, the tolerance of semiconductor structures for the charge carried by particles impinging on them during the manufacturing process has become quite limited and structures for dissipating such charges during manufacture are sometimes required; often complicating the design of the device.

While this latter problem could be avoided by performing processing with neutral particles, the charge of an ion or electron is the only property by which the particles can be manipulated and guided. Therefore, an ion must remain in a charged state until its trajectory can be established and the energy of the ion must be sufficient that its trajectory will remain substantially unchanged when neutralized by an electron. Even then, the trajectory may be altered and the flux of a neutral beam be severely depleted by collisions with other particles which may or may not have been neutralized and which may have trajectories which are not precisely parallel. Higher energies than are tolerable for semiconductor processing have been necessary to obtain such trajectories of neutral particles and, in any event, no device capable of providing any significant flux of neutral particles in a well-collimated beam has been developed to date. Further, once particles have been neutralized, there is no longer any property of the particles which can be exploited to remove energy from the particles in the beam to reduce particle energy to levels which are useful for semiconductor processing.

A further complicating factor is the quantum mechanical process by which neutralization of a particle by ion-electron (+/e−) recombination to reach a state where the electron is bound to the ion (as opposed to a space charge neutralized beam, referred to hereinafter as a pseudo-neutral beam, in which the ions and electrons are of substantially equal populations but are not bound together) takes place (e.g. by so-called photon mediated two-body radiative recombination, fragmentation two-body recombination, molecular modes excitation two-body recombination and other known or theoretical processes). While the underlying physical processes will be discussed in greater detail below, the allowed states of each of the recombination mechanisms are such that the probability of recombination is extremely small in free space due to both the low particle density in the high vacuum (about $5\times10^{-5}$ Torr) and the distances available (about 2 mm) because of the mean free path of the particles and the simultaneous requirements of conservation of energy and momentum, causing the electron to assume an auto-ionization state after collision with an ion unless the center of mass frame (CMF) is zero or near-zero. Previously attempted processes such as a charge exchange process in which an ion beam is passed through a neutral medium are therefore largely ineffective to produce a significant population of neutral particles and the energies required to maintain even a depleted beam after passing through such a neutral medium are far in excess of the energies which are tolerable for semiconductor processing.

Nevertheless, there are other factors in semiconductor processing which cause continuing interest in the production of a beam of neutral particles. For example, while many highly effective lithographic, chemical and metallurgical processes are known for the formation of semiconductor device structures at relatively high yield, many of these processes have characteristics which are less than fully desirable. For example, the process of choice for preferentially etching $SiO_2$ over silicon (as may be encountered at an interface oxide in processes which are generically referred to as interface tailoring) is an isotropic wet etch process using hydrofluoric acid (HF), referred to as a buffered hydrofluoric acid (BHF) dip, which, while highly effective for the purpose, has the disadvantages of involving unavoidable atmospheric exposure and the possibility of contamination of the etching solution with reaction products and other possible contaminants.

Beyond the reduction in manufacturing yield inherent in this process, such a wet etch requires far more of the material than can possibly take part in the chemical reactions of the etching process since a sufficient quantity of HF must be contained for immersion of the wafers and to provide good circulation of the etchant around the wafers. However, no alternatives to the volume requirements of a wet etch process, particularly using HF, have previously been available. Beyond the expense of providing and containing such a volume of etchant, HF is known to be a particularly strong acid with high chemical activity and highly destructive to biological tissue with which it comes in contact. Therefore, the mere existence of substantial quantities of such an etchant represents a potential biological and ecological hazard and further precautions for containment and protection of personnel during use of such materials presents a substantial further cost component in the manufacture of semiconductor integrated circuits.

In some other chemical and metallurgical processes, it has been possible to reduce the amounts of reactants and enhance delivery to the location of the semiconductor material by plasma processes and numerous such techniques are known such as sputtering and reactive ion etching (RIE). However, the development of plasma chemistry processes is largely an empirical art and the result of slight variations in plasma chemistry processes is not generally predictable, due to the nature of the plasma itself.

More specifically, a plasma is a state of material occupying a volume in which a significant percentage of the materials present are in the form of ionized species and electrons. Within a so-called quiescent plasma many dynamic processes are in substantial equilibrium. That is, in a steady-state or quiescent plasma, the production of ionized species equals the loss of ionized species by recombination. If ions or electrons are extracted from the plasma, they must be replaced by a current input and/or material flux.

Perhaps most important to an understanding of the dynamic nature of a plasma is that the major, inner, portion of a quiescent plasma is substantially space-charge neutralized with the net mutual repulsion between like-charged species balanced by mutual attraction between oppositely charged species. This means, for any charged particle which is well-separated from the boundary of the plasma but having a trajectory toward the boundary of the plasma, a force will be exerted on the plasma which tends to pull it back toward the plasma. Therefore, most of the volume of the plasma can be regarded as generally homogeneous.

However, within this population of charged species the electron mobility is far greater than that of the ions. Therefore the electrons tend to leave the ions at the boundary of the plasma, creating a so-called ambipolar potential. Therefore, there is a slightly greater population of ions near the boundary of the plasma and the repulsion forces therebetween also tends to accelerate the ions outwardly. This acceleration of ions will, however, decrease with increasing distance from the boundary of the plasma while electron acceleration increases. These conditions are effectively reversed when the boundary of the plasma is near a conductive surface which tends to return electrons to the plasma and to accelerate ions.

Therefore, either ions or electrons can escape from the plasma and it is seen that a quiescent plasma represents a source/sink dynamic balance and is neutral overall. However, because of the conditions at the boundary which assist the attainment of a dynamic balance, there is no good balance at any point within the plasma. Unfortunately, any surface at which chemical processes are conducted with the plasma is, by definition, such a boundary.

The conditions which prevail in the vicinity of the boundary have not been well-understood and the populations of charged or neutral species which may be present at the surface to take part in a lithographic, chemical or metallurgical process is largely unpredictable. For example, increasing a partial pressure of gas A in a plasma reactor will not necessarily lead to a predictable increase in reaction product AB. The plasma dynamics at the boundary of a plasma are further complicated by the fact that any contact of the plasma with a metallic or conductive surface causes the surface to be negative relative to the plasma and the plasma adjacent to the surface to be positive. This voltage differential is called the plasma potential. Therefore, at the boundary of a quiescent plasma, ions will be accelerated away from the plasma and the energies, trajectories and distributions of the ions at the target is not readily predictable. Further, if the plasma potential is increased to increase ion flux, as is generally desirable, energy of the ions may be increased to levels which can damage the crystal lattice structure of a semiconductor material.

It should also be recognized that any device which can form a directed stream of accelerated particles has potential applications far beyond semiconductor metallurgy due to well-established classical laws of motion. Many applications exist where transfer of kinetic energy between objects is desirable. Even the simple act of driving a nail into a piece of wood relies of the simple mechanism of impacting a fast-moving mass on another mass which is desired to be moved. Applications abound where the impact of highly accelerated minute particles to impart kinetic energy to objects would be desirable. Similarly, the process of acceleration of a particle produces a reaction thrust. However, either of these types of applications require production of a stream of particles outside the apparatus which produces the stream and no apparatus has heretofore been devised which is capable of producing a stream of highly accelerated particles (either charged or neutral) beyond the confines of the device itself.

SUMMARY OF THE INVENTION

It is therefore an object of the present invention to provide a beam of neutral particles of arbitrary energy which may be as low as a few electron volts and as large as tens of thousands of electron volts or larger.

It is another object of the invention to provide an apparatus and methodology for in situ generation of chemical reactants in quantities similar to the quantities required for a specific chemical reaction and with controlled distribution for material processing.

It is a further object of the invention to provide an apparatus and methodology for accurately and controllably delivering a desired flux of material to a surface of a semiconductor material at energies below that which will damage the crystal lattice of the semiconductor material.

It is yet another object of the present invention to provide an apparatus and methodology for developing a beam of highly accelerated neutral particles which can extend beyond the confines of the apparatus which is useful to transfer kinetic energy to an arbitrary object.

It is yet another object of the invention to provide a "dry" high vacuum compatible technique for etching $SiO_2$ and other materials with molecular quantities of hydrofluoric acid to replace wet HF treatment techniques, particularly for interface tailoring of $SiO_2$ over silicon.

In order to accomplish these and other objects of the invention, a method is provided for extracting particles from a plasma through an aperture including the step of regulating the relative populations of particles extracted from the plasma by dimensions of said aperture in combination with at least one of differential vacuum pumping and ion density in said plasma.

In accordance with another aspect of the invention, a method of in-situ formation of a reactant is provided including the steps of extracting ions of a first material and electrons from a plasma, neutralizing a portion of a population of the ions with electrons by passage through an aperture in a plasma-confining surface to form a neutral beam, and passing the beam through a low pressure gas containing a second material.

In accordance with a further aspect of the invention, an apparatus for producing a beam of neutral particles is provided including an arrangement for forming a plasma having a plasma sheath, and a neutralizer plate having at least one aperture having a transverse dimension which is approximately equal to or less than said thickness of the plasma sheath.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

It is essential to visualization and an understanding of the present invention to first understand the concept of a plasma sheath and to understand particular terms which will be used in this description of the invention. In particular, some terminology in common usage in the art is illusory and may cause substantial confusion as to the nature of some features of the present invention. Most importantly, the term "neutral beam" has been applied in the literature to a space-charge neutralized beam but which may contain relatively few neutral particles, if any. The term is therefore correct only in the limited sense that there will be substantially equal populations of electrons and ions and the term "pseudo-neutralized beam" will be used hereinafter to indicate that electrons and ions are not, in fact, bound to each other and to distinguish a space-charge neutralized beam from the beam of neutral particles which the present invention is capable of producing. The "pseudo-" prefix will also be used in other instances and with other terms to indicate that the ions and electrons are not bound even though they may be closely associated in other ways. As used herein, the term "neutral beam" will be used to connote a beam containing a significant population of neutral particles in which electrons and ions are bound in the neutral particle.

The region between the outermost portion of the plasma which has substantially equal numbers of ions and electrons over any arbitrary incremental volume thereof and a plasma confining surface (which causes a boundary condition) will be referred to as the "plasma sheath". An example of a region of a plasma sheath is the dark region at the ends of a so-called fluorescent lighting tube. As a fluorescent lighting tube ages, material is deposited on the tube walls which increases conductivity of those regions of the tube, causing the plasma to be confined to a smaller region of the tube and the dark area to expand. The plasma sheath can also be considered as the region in which the plasma potential exists.

The thickness of the plasma sheath is on the order of the Debye length which corresponds to the mean free path or mean distance an ion will travel in a quiescent plasma, under the conditions which sustain the plasma, before neutralization by recombination with an electron occurs. Additionally, it may be useful to consider the definition of the inner bound of the plasma sheath as being located where a balance of inward and outward fluxes of ions and electrons exists nearest to a plasma confining conductive surface. It is important to understand that ions and electrons from the plasma will both be present in substantial populations within the boundaries of the plasma sheath.

Figure 1:
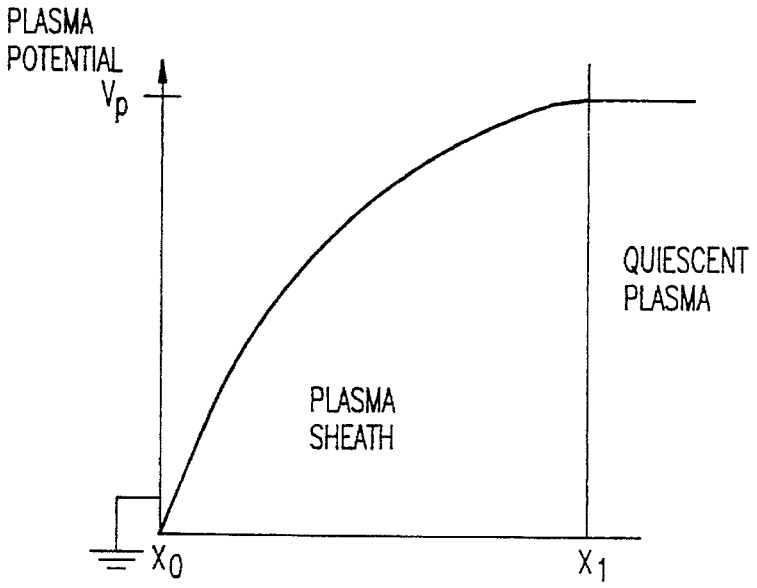
FIGS. 1 and 2 are graphical depictions of representing particle dynamics at the boundary of a quiescent plasma which are useful for an understanding of the discovery underlying the invention.

Referring now to the drawings, and more particularly to FIG. 1, there is shown a graph of the potential at locations within the thickness of the plasma sheath in accordance with a theory, now experimentally verified, underlying the invention. For reference, the Y-axis may be considered to be at he location of a conductive plasma containment surface located at $X_0$ with the quiescent plasma existing to the right of $X_1$. The plasma potential $V_p$ is constant to the right of $X_1$ and the potential is seen to decrease at locations to the left of $X_1$ as the plasma confinement surface is approached. This change of potential between $X_0$ and $X_1$ represents an electrical field which will act differentially on electrons and ions which are present in the region.

Figure 2:
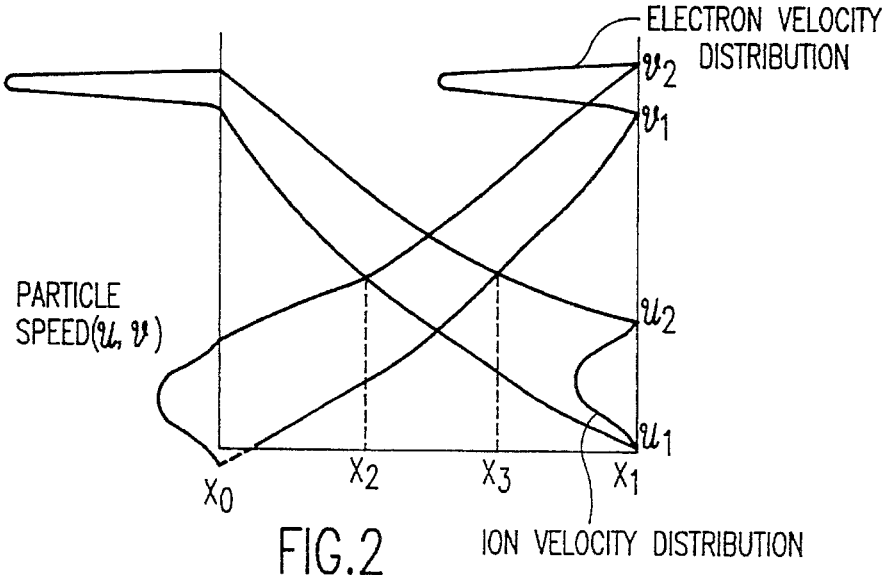

This differential action (reduced for clarity to a one-dimensional model in a direction which may be considered perpendicular to the plasma confining conductive surface) is depicted in the graph of FIG. 2. Recalling from the definition of the plasma sheath, above, the fluxes of ions and electrons are balanced at $X_1$ and, considering now only the ions and electrons which have a velocity component directed from the quiescent plasma into the plasma sheath (e.g. to the left) the relative velocities of both the ions (u) and electrons (v) will be distributed in accordance with some statistical function (e.g. Gaussian with $3\sigma$ points $v_1$, $v_2$ for electrons and $u_1$, $u_2$ for ions) as shown. It will be noted that the initial electron velocity is much higher than the initial ion velocity at $X_1$ for a given plasma potential, $V_p$, or energy because of the much lower mass of electrons.

As electrons and ions enter the sheath, the change of potential/electric field, E, causes the ions to be accelerated and the electrons to be decelerated. This results in the existence of a region between $X_2$ and $X_3$ where velocities of both species will be comparable. It should be noted that the velocity distributions will also change toward $X_0$ and will be comparable in the region between $X_2$ and $X_3$. Therefore, a region will exist at some location within the plasma sheath where the center of mass frame (CMF) energy (e.g. using the center of mass of a population of particles as a frame of reference) is low and recombination of ions and electrons can occur by photon mediated recombination and other possible mechanisms while both energy and momentum are conserved. Thus recombination is greatly favored due to Coulombic interaction of electrons and ions in this low-CMF energy region even though the probability of radiative recombination within the quiescent plasma remains low.

It should be noted that it is not necessary to quantify these effects or to find a specific location of either of $X_2$ and $X_3$ or even the location of the inner bound of the plasma sheath $X_1$. (In fact, the shapes of the curves $u_1$ and $u_2$ will change dramatically with ion mass and scaling will occur with $V_p$. However, there will always be an intersection since the electrons are being decelerated while the ions are being accelerated.) It is entirely sufficient to an understanding of the basic theory of the invention that such a low-CMF energy region exists near (e.g. within a Debye length of) a conductive surface which confines a plasma. By the same token, it is a basic aspect of the invention that a region can be created which favors recombination of ions and electrons much more strongly than conditions in a quiescent plasma by the provision of a conductive surface adjacent the plasma. This recombination phenomenon will be hereinafter referred to as electric field mediated recombination.

Figure 3:
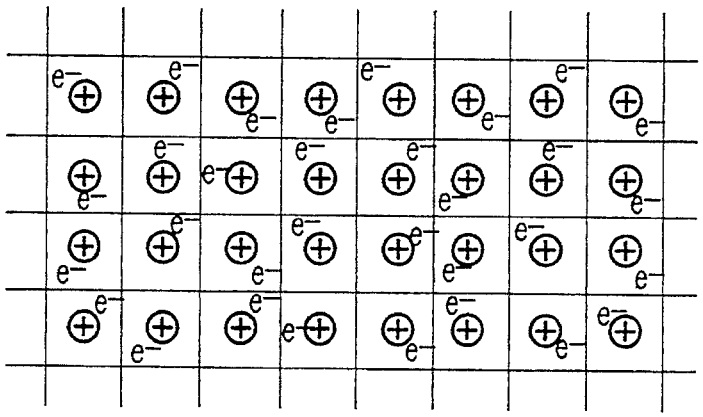
FIG. 3 is a diagram of a pseudo-bound state of electrons and ions which may be considered to exist in a particular region of FIG. 2.

Considered in a slightly different fashion, within the low-CMF energy region between $X_2$ and $X_3$, there is an approximately equal population of electrons (e−) and ions (+) with comparable energy distributions. Therefore, within the low-CMF energy region, the electrons and ions can be considered as a collection of electron and ion pairs which can then interact Coulombicly. Both the electrons and ions are Boltzmann particles before forming a real bound state. Accordingly, the low-CMF energy region can be considered as being divided into arbitrary identical cellular volumes with an ion (+) at the center of each cell and the number of cells equal to the number of ions, as shown in FIG. 3.

Somewhat more analytically, the Hamiltonian for a simple system of e− and + is $$H=(p^2/2m)+V(r)$$

where p is the momentum, m is the mass, r is the center of mass coordinate of the pair and V(r) is the potential energy. For the collection of e− and +, the expression becomes $$H=(p^2/2m)+V(r)+Vp(R)$$

where R is the coordinate of the cell (arbitrarily choosing the interface between the plasma and the plasma sheath as the origin) and Vp(R) is the electrostatic potential component of the energy. The energy eigenvalue of the new Hamiltonian expression defines a new pseudo-bound state which is dependent of Vp(R). Therefore, throughout one ion's transit time across the sheath before neutralization/recombination, there is always one electron interacting with each ion. Vp(R) becomes effectively zero when a bound state is formed and the Hamiltonian returns to its original form.

The behavior of the plasma sheath at a discontinuity of a conductive surface will now be considered. Generally, a plasma sheath closely follows a conductive surface which confines a plasma. However, as mentioned above, the sheath thickness is on the order of the Debye length $\lambda_d$ which is given by $$\lambda_d=\left(\frac{k_bT_o}{4\pi\eta_e q^2}\right)^{1/2}$$

where $\eta_e$ is the electron density in the plasma, q is the charge and To is the temperature of the plasma. Some exemplary values of sheath thickness for a variety of combinations of $V_p$ and n are given in FIG. 4. For comparison with the above equation, sheath thickness, d, is approximated by $$d \sim (eV_p)^{2/3} n^{-1/2} Te^{-1/6}$$

From the equation and the table, it can be seen that the sheath thickness decreases by approximately a factor of three for each ten-fold increase in plasma density and that for even relatively low values of $V_p$ and relatively high plasma densities, the sheath thickness remains of a relatively large dimension which can be seen by the unaided eye.

Figures 4, 5:
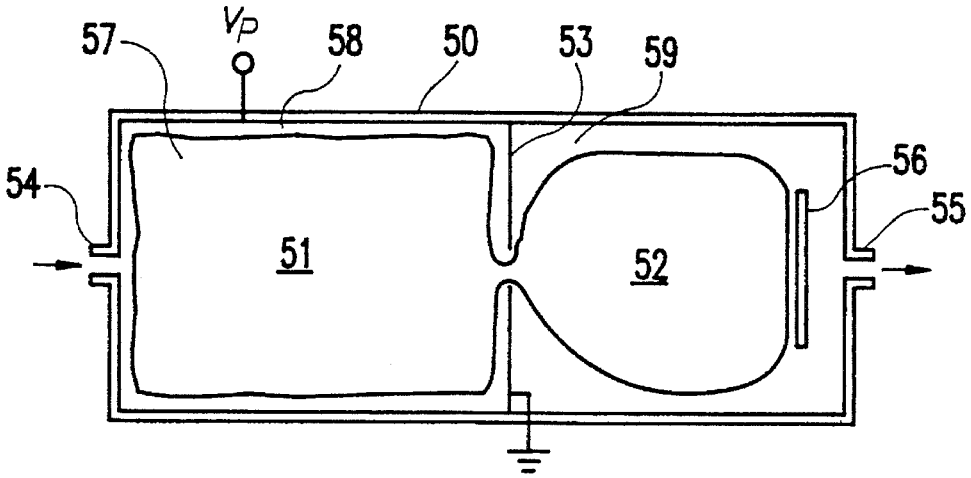
FIG. 4 is a table of exemplary values of thickness of the plasma sheath for some plasma parameters of interest.
FIG. 5 is a schematic, cross-sectional view of a generalized plasma reactor useful in understanding the principles of the invention.

Having established that a region will exist at some location within the plasma sheath where neutralization of ions by binding with electron will be favored, FIG. 5 shows a schematic, cross-sectional view of a hypothetical device which is useful for conveying an understanding of some principles of the invention which are important to the practice of the invention for producing of a high-flux neutral particle beam. It is to be understood that this illustration is highly schematic and of a form intended to improve understanding of the present invention and no admission that any portion thereof is prior art as to the present invention is to be inferred from the depiction in FIG. 5.

Housing 50 is a vacuum chamber which is divided into sub-chambers 51 and 52 by an apertured partition 53. The pressure in chamber 50 is reduced to a high vacuum by pumping at outlet 55, which also serves to remove reaction products from the chamber once the plasma reaction is begun. Reaction gases are supplied to the interior of chamber 50 through inlet 54. A plasma 57 is formed in chamber 51 by any of a number of known ways (e.g. electron cyclotron resonant (ECR) heated plasma, RF capacitively heated plasma, Rf inductively heated plasma, a streaming plasma as in a plasma beam, a quiescent plasma, etc.) and its potential is established by application of $V_p$ to chamber 51 relative to a reference voltage applied to apertured partition 53 which serves to accelerate ions toward a target (e.g. a wafer) 56 in chamber 52. It is assumed that all surfaces are conductive to contain the plasma and plasma sheath 58 follows the inner surface of chamber 51. Since extraction of ions from the plasma is largely a ballistic effect and the plasma is only driven in chamber 51 the plasma is depicted as less extensive in chamber 52. (The shape of the plasma volume depicted assumes this partition 53 has a relatively large aperture, as will be discussed more fully below.) Neutral particles will be generated and will be present in regions 59 but are not directed toward the target 56 in significant populations.

It should be noted that the plasma becomes diffuse due to mutual repulsion between the like-charged ions which are not space charge neutralized since electrons are largely rejected by apertured partition 53. For that reason, the arrangement schematically depicted in FIG. 5 would not be considered to be an ion "beam" device. Nevertheless, some electrons are supplied by relatively negatively charged partition 53 which is often referred to as a neutralizer plate or, simply, "neutralizer" even though the percentage of the ion population which is neutralized is very small. It should also be noted that the distribution of ions at the target 56 is not well-regulated and, if ions of different mass are present, relative concentrations will vary across the target.

It should also be noted that the aperture in plate 53 is depicted as being of substantial size, as noted above. Such a sizing is consistent with ion extraction grids since, in ion beam devices some material deposition will occur on all interior surfaces of housing 50 and particularly on plate 53 which carries a relatively negative charge in order to attract ions and extract them from the plasma. A larger opening thus provided a longer service life for the plate or extraction grid in such devices but the dimensions of the opening were not otherwise considered to be of particular importance. Further, while multiply apertured plates have been used to increase ion flux in ion beam devices such as those in the above cited U.S. Patents to Keller et al. (as contrasted with the device schematically depicted in FIG. 5), no possibility for control of the plasma sheath or any advantage to be gained thereby has been recognized. On the contrary, it was considered desirable in many cases (e.g. for space charge neutralization) for the quiescent plasma itself to emerge through the aperture, in the manner shown in FIG. 5.

Control of the plasma sheath and the derivation of a beam of neutral particles thereby is a further discovery by the inventors which underlies the operation of the present invention. More specifically, the inventors have discovered that both the plasma sheath geometry and the relative populations of species of particles can be controlled by the diameter and aspect ratio of apertures in the neutralizer plate 53 as will now be discussed.

Given the apparatus of FIG. 5 which uses an apertured plate 53 carrying a relatively negative charge to accelerate ions, there will be three components of the flux from chamber 51 into chamber 52 through the aperture in apertured plate 53:

a.) Those few ions which are actually neutralized by the neutralizer plate 53 and are not acted upon further by the potential on the neutralizer plate form a beam of fast neutral particles although the population of such particles is small and the beam is not well-directed.

b.) Ions which are not neutralized by passing through the neutralizer plate are decelerated by the potential on the neutralizer plate after passing through it and form an effusive beam of slow particles which may or may not be space charge neutralized. The trajectories of these ions is also not well-regulated, contributing to the effusive nature of this component of the flux. Electrons may thereafter become bound to these ions, resulting in what is termed an effusive neutral beam.

c.) Remaining ions and electrons which are unaffected by the extraction process form a third component of the flux which is essentially an extended region of quiescent plasma, as shown in FIG. 5.

These three components, the fast neutral particles, the effusive neutral beam and the quiescent plasma, will generally be present in ascending order of particle populations and descending order of directivity. That is, the population of fast neutral particles will be far less than the population of particles in the effusive beam and the number of particles in the effusive neutral beam will generally be less than the number of particles in the quiescent plasma although the ratio of these latter two populations may be affected by other plasma parameters. Similarly, only the particles in the fast neutral beam will have an established trajectory toward the target 56 and the effusive beam component is only generally directed toward the target. The quiescent plasma component only carries particles to the target by virtue of the extent of the largely homogeneous plasma and any relatively negative charge which can be placed on the target since ion motion will be dominated by the dynamics of the plasma itself.

Figure 6:
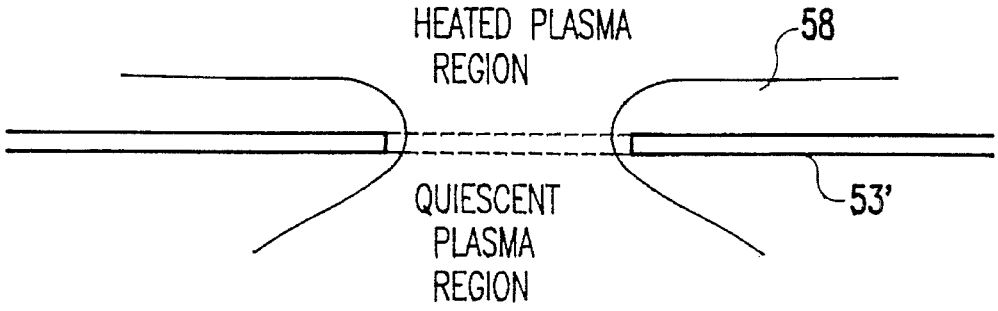
FIG. 6 depicts the geometry of a plasma sheath at a low aspect ratio aperture of relatively large diameter.

FIG. 6 depicts, in cross-section, an aperture in a plate 53' which is large in comparison to the plasma sheath thickness and generally corresponding to the type of aperture depicted in neutralizer plate 53 in FIG. 5. (It should be noted that the shape of the aperture need not be circular and the effect on the plasma sheath will follow the contour of the perimeter of the aperture if the transverse dimension is large relative to the thickness of the plasma sheath. However, the term "diameter" will be used as a matter of convenience to connote the transverse dimension of any aperture of arbitrary shape in the following discussion.) In this case, it can be seen that the inner boundary of the plasma sheath 58 closely follows the surface of plate 53' in the heated plasma region and that quiescent plasma extends through the aperture of the plate and largely follows the contour of the plasma confining surface. As described above, therefore, the principal component of the particle flux will be the quiescent plasma and the particle populations in the fast neutral particle beam and effusive neutral beam components will be far smaller and generally negligible at plasma potentials useful for semiconductor processing.

To summarize the foregoing, the flux of fast neutral particles will be very small principally for three reason which can be observed from FIG. 6. First, since the quiescent plasma extends entirely through the aperture in plate 53', no plasma sheath is traversed in the vicinity of the aperture to provide a region where neutralization by binding with electrons will be favored. Second, the potential gradient established by the voltage on plate 53' must be relatively high to establish a trajectory for any significant population of ions. If this potential is limited to limit the velocity of ions to levels useful in semiconductor processing, the population of fast neutral particles for which such a trajectory is established will be markedly reduced. Third, since the quiescent plasma extends into the second chamber 52, the only selectivity between particles passing through the aperture in plate 53 is the rejection of a substantial proportion of the electrons in the plasma, further reducing the likelihood of recombination.

Figure 7:
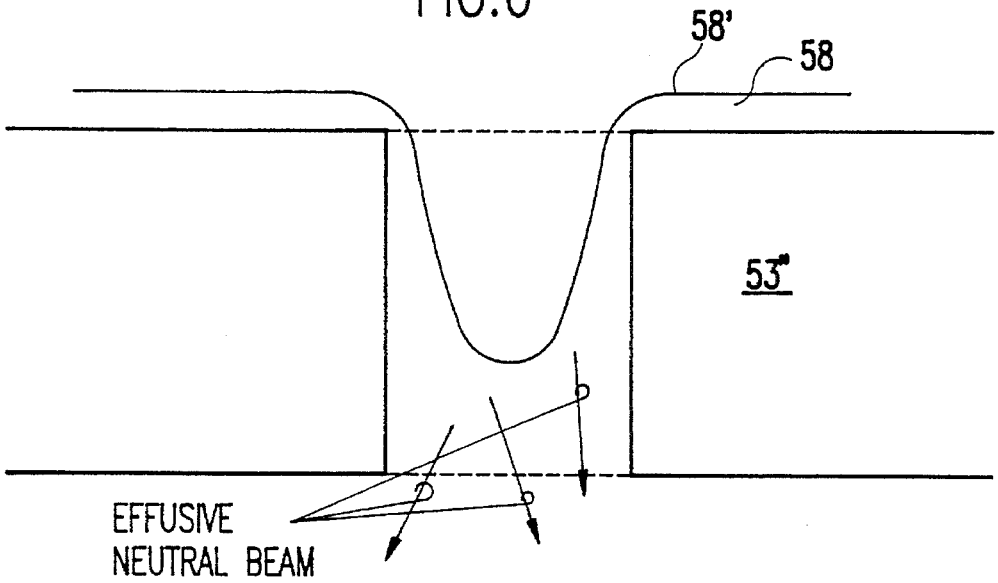
FIG. 7 depicts the geometry of a plasma sheath at a high aspect ratio aperture of relatively large diameter.

If the aspect ratio (depth to diameter) of the aperture is increased, as shown in FIG. 7, in which a plate 53" of increased thickness is depicted, the contour of the inner boundary of the plasma sheath 58 prior to the surface of the plate will be approximately the same as in FIG. 6. However, within the length of the aperture, the plasma sheath will follow the contour of the aperture even more closely than in chamber 51 due to reduced ion density and the plasma density may become vanishingly small if the aperture is sufficiently deep relative to the Debye length, as shown where the plasma sheath does not extend entirely through the depth of the aperture.

For apertures having a diameter d greater than the Debye length, an aperture length of depth (e.g. grid thickness) L satisfying the inequality $L \geqq d^2/4\lambda_d$ will assure that the plasma does not extend beyond the aperture. Since the low-CMF energy region will exist in the vicinity of the inner boundary 58' of the sheath 58, a substantial amount of ions will become neutralized by having electrons become bound to them. However, the extension of the plasma into the aperture and near to the surface thereof limits the directivity of the beam of neutral particles which are produced in the plasma sheath. Therefore, the effusive neutral beam component will become dominant over the quiescent plasma component of the flux through the aperture. The fast neutral particle component will remain about the same as in FIG. 6 although recombination should be somewhat favored by the existence of a plasma sheath but may effectively become smaller since the outer boundary of the plasma sheath is distant (and the region favoring recombination is not well-defined and has an effectively reduced density of ions and electrons. Further, the curvature of the inner boundary of the plasma sheath causes the distribution of trajectories of ions which may be neutralized to approximate the distribution trajectories of the particles in the effusive beam. The irregularity of trajectories of fast neutral particles not only destroys any beam-like qualities of the fast neutral particle population but also will cause collisions of particles whereby neutral particle motion will become further randomized.

However, as discovered by the inventors, if the diameter of the aperture in plate 53''' is on the order of the Debye distance or smaller, and the aspect ratio maintained at 1:1 or somewhat more, the geometry of the plasma sheath is substantially unaffected from the geometry which would be caused by an unapertured plate and remains substantially planar. Likewise, the low-CMF energy region between $X_2$ and $X_3$ will remain substantially planar and well-confined to a region where significant populations of ions and electrons will be present. Therefore, a region where ion and electron recombination is favored will exist adjacent to but not necessarily within the aperture and the number of fast neutral particles will be made to increase relative to the ion population of the effusive beam. The heated or quiescent plasma is fully confined and does not form a component of the particle flux through the aperture. The flux through the aperture, however, will also contain some effusive neutral beam component although the effusive neutral beam component will be reduced by increasing the aspect ratio of the aperture.

Since the particles in the effusive neutral beam component are not yet bound to electrons at locations close to the neutralizer plate 53''' (which can, in this case, be regarded as much more truly a "neutralizer" than if configured in accordance with FIG. 6 or 7) they can be separated from the beam of neutralized particles by a negatively charged plate 80 or a magnetic field near the neutralizer plate 53'''. Those with trajectories sufficiently close to the substantially parallel trajectories of the fast neutral particles often need not be separated from the beam and may significantly contribute to the flux of the beam and, if suitably limited by the aspect ratio of the aperture, need not be collected unless the presence of charged particles would interfere with the intended chemical reaction.

Thus the apertured plate having apertures of a diameter approximating the Debye length (or the sheath thickness) and a depth of a small multiple (e.g. 2–4 times) the Debye length not only filters the particles emerging from the aperture, but also contributes to the increase of particle flux in the fast neutral particle beam relative to the effusive beam. The filtration of neutral particles from charged particles can be further enhanced by electrostatic or magnetic separation from the fast neutral particle beam and collection.

Therefore, it is seen that a beam of high directivity can be formed of an increased population of neutral particles in which electrons are fully bound, in accordance with the invention. Further, for a given plasma density, the total flux of neutral particles can be increased at will by increasing the number of apertures provided. The separation of the apertures does not appear to affect the plasma sheath geometry. It should also be noted that this mechanism of recombination and formation of a beam of neutral particles is not restricted by the type or parameters of the plasma, the technique by which the plasma is produced or the material of or electrical bias applied to the neutralizer. Therefore, the methodology and structure of the invention are fully scalable to plasmas of virtually any energy and can produce virtually any desired level of particle flux and particle acceleration well beyond the range of applicability to semiconductor processing as may be useful for kinetic energy transfer applications briefly mentioned above.

In this regard, it should be noted from FIG. 4 that while increased plasma densities cause a decrease in the Debye distance (and the maximum dimension of apertures), and may thus be limited as a matter of design of a high kinetic energy system, larger values of $V_p$ call for larger apertures. Therefore, greater acceleration of ions will allow greater plasma densities to be employed for a given size of aperture as would be desirable in a kinetic energy transfer system. Accordingly, a single size of aperture may then be used to provide a wide range of kinetic energy by simultaneously regulating both plasma density and particle acceleration ($V_p$).

Conversely, as explicitly shown in FIG. 4, apertures which can be made with mechanical tools such as drills are sufficient to carry the process to very low values of $V_p$ which are below the energies which are known to damage semiconductor crystal lattices at sufficiently high plasma densities that useful levels of particle flux can be obtained. If necessary, however, for neutral particle beam flux at extremely low energies, lithography processes could be used to obtain smaller diameter apertures. In this latter regard, the increase of flux by increasing the number of apertures also has the effect of broadening the beam (but which will nevertheless be non-divergent) and will therefore increase uniformity of particle concentrations at the target if the pattern of apertures covers approximately the same area as the target.

It should also be noted that since the invention is operable at any $V_p$ which is adequate to extract ions from the plasma, and that the populations of any of the components of particle flux can be relatively proportioned by aperture dimensions, a further possibility for ion neutralization is presented by the invention as will be discussed in more detail below. Simply put, it is also possible to modulate $V_p$ in such a way that electrons will be extracted from the plasma during periods which alternate with periods during which ions are extracted. Therefore, since the population of ions extracted can be accurately determined empirically and varied by $V_p$ and the plasma density, roughly equal numbers of electrons can also be extracted from the plasma into, for example, an effusive neutral beam to enhance the binding to ions remaining therein.

Further, since comparable potential differences will produce much higher velocity electrons, limiting divergence, a high percentage of electrons may be made to strike the target to neutralize charge which may accumulate at insulative or isolation structures thereon and to thus avoid breakdown damage to such structures. All that is then necessary is to limit the respective durations during which extraction of ions and electrons are respectively done to periods shorter than will allow buildup of an excessive voltage level (e.g. by increasing the modulation frequency). It should also be noted in regard to this process that accumulated charge, whether positive or negative, will preferentially attract particles which will carry a charge which would neutralize the built-up charge. Therefore, modulation of $V_p$ is extremely effective to prevent voltage breakdown damage during semiconductor processing.

It is also to be appreciated that the mechanism of production of a region where electric field mediated recombination of ions and electrons is favored is an incident of the existence of an electric field gradient which may be produced in many ways such as a succession of grids or with magnetic fields and does not necessarily require the existence of a plasma sheath. However, as described above, the existence of a plasma sheath near a plasma-confining boundary is an especially convenient way to cause electric field mediated recombination to be favored.

To summarize the foregoing, it has been demonstrated how the engineering of holes in an apertured plate in the presence of a plasma can be used to control the relative and total fluxes, relative populations, energies and trajectories of particles extracted from the plasma. In a real or hypothetical device such as that of FIG. 5, relative pressures in sub-chambers 51 and 52 can also affect total flux, relative populations of particles and particle trajectories. It will be recalled from the discussion of FIG. 5 that, while the overall device was operated at high vacuum, gas was supplied to the plasma in chamber 51 through inlet 54 and reaction products extracted at outlet 55. Thus there is also a net fluid flow through the apertured plate 53.

Depending on the amount of restriction of this fluid flow by apertures in plate 53, a differential pressure can be achieved between chambers 51 and 52 and a substantial component of particle velocities may be achieved in addition to acceleration by the potential applied to neutralizer plate 53. A higher velocity and pumping speed will tend to increase! the extent to which the effusive beam is space charge neutralized in addition to increasing the flux and directivity and thus may also contribute to recombination and increase of neutral particle flux and hence the quality factor of the neutral beam. By the same token and especially since a given aperture geometry can be used, by varying other parameters of the plasma and operation of the device, substantial restriction of the net gas flow through the apertures can allow operation of chamber 51 at higher pressures (although still at deep vacuum levels) to increase plasma ion populations and flux. This is consistent with the fact that the Debye length will decrease (requiring smaller apertures) at higher ion populations or concentrations in the plasma. Thus it is seen that the principles of the invention can be employed in the engineering of the apertures in and the adjustment of electric field gradients at plate 53 in accordance with the invention to provide virtually any desired conditions of ion, electron or neutral particle flux, trajectories and relative populations in chamber 52. It will also be recalled that the term neutralizer plate, applied to apertured plate 53 or other such plates or grids was a matter of convention and the nature or degree of neutralization which takes place depends of the potential applied thereto as well as the geometry of the apertures therein and parameters of the plasma.

The quality factor of the beam is also affected by the degree of ionizatic, n within the plasma. However, high percentage ionization is also associated with high plasma temperatures (Te) which can cause erosion of plasma confinement surfaces and lead to contamination when the invention is used for microelectronics device processing. In such a case, therefore, lower percentage ionization must be tolerated and quality factor maximized by pumping speed while, if contamination is not important, as in a kinetic energy transfer system, the opposite would be true to the extent that erosion could be made tolerable such as with magnetic mirror confinement and which can also be used at lower ionization percentages to limit erosion and contamination. For comparison, while ECR heated plasmas can achieve a high percentage ionization at high Te, 10% ionization has only recently been achieved at a much lower Te of about 50 eV and $V_p$ a of about 70 eV; values which remain too high for semiconductor processing.

Figure 9:
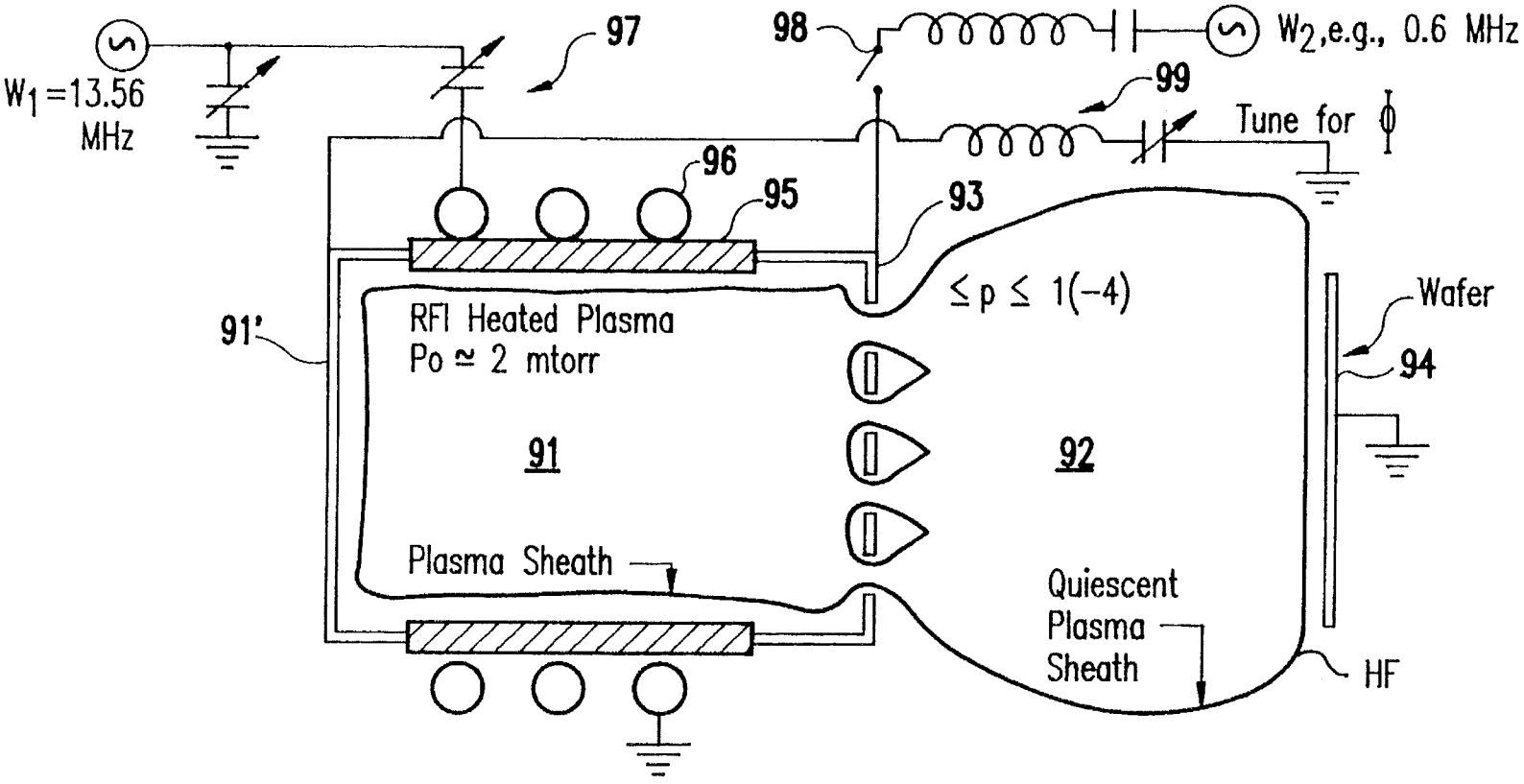
FIG. 9 illustrates an arrangement useful in the practice of the invention with active biasing for adjustment of gas mix.

Having described the basic theory of the invention, several variations of the invention which exploit the underlying discoveries will now be described. Referring now to FIG. 9, a first variation of FIG. 5, exploiting the principles of the invention is schematically illustrated in similar cross-section. In this case, the arrangement is intended for the fine tuning of the gas mix including ions and electrons using an alternating current applied to the neutralizer plate 53. Further, this variation of the invention does not preferentially provide fast neutral species. Therefore, this arrangement is useful for any process where a broad ion beam would be employed but, as alluded to above, provides the advantage of avoiding large charge build-up on the target which could cause unevenness of the process or damage through dielectric breakdown.

In the illustration of FIG. 9 (and many of the following Figures), the pumping arrangement is omitted in the interest of clarity. Further, for the same reason, no chamber is shown to the right of neutralizer plate 93 surrounding the target wafer 94. (While some level of vacuum is necessary if destruction of the beam of neutral particles due to collision with other molecules is to be avoided, that level of vacuum may be achieved in the environment of the invention, such as enclosing the entire apparatus in a vacuum chamber. It is also possible that in some applications, maintenance of the beam over any significant distance beyond the neutralizer plate of the device may not be necessary.) As a further convention which will be followed in many of the following Figures, lateral portions of chamber 91 are depicted as insulators as is preferred to minimize loss of ionized species through charge transfer with these surfaces and for convenience of modular construction of practical embodiments of the invention, as will be described below. Surface 91' is preferably formed of metal and a voltage of a few volts less than the plasma potential (Vp is typically around 42 eV for semiconductor processing applications) is applied thereto. This configuration allows a potential, Φ, to be applied across the plasma to provide acceleration of the charged species in the plasma. To provide a sufficiently high degree of ionization of the plasma, RF heating (or "pumping") of the plasma is applied in this embodiment of the invention, for example, by inductive coupling from coil 96 driven by an oscillator with capacitors 97 used to achieve greater efficiency through resonance. A frequency of 13.56 MHz has been used but is not particularly critical to the practice of the invention.

It should be understood that if apertured plate 93 were simply held at ground potential, the components passing through the apertured plate 93 would be governed by the above described aperture geometry and pressure. (Note that pressure in chamber 91 is held at approximately 2 mTorr and the pressure in chamber 92 is held at about $10^{-4}$ Torr.) If the aperture geometry is such that the particle populations in the plasma are not preferentially filtered or neutralization favored, approximately the same or at least comparable populations and proportions will exist in chamber 92. Further, the pressure in chamber 92 can be maintained below that in chamber 91. Therefore, plasma heating in chamber 91 can be used to provide a quiescent plasma with high degree of ionization in chamber 92.

Adjustment of the relative populations of ions and electrons can also be achieved in the embodiment of FIG. 9 in a manner which will now be discussed. Due to the electrical isolation of plate 93 and chamber surface 91', a capacitance will exist across the length of chamber 91, If tunable resonant LC circuits are connected to each of surface 91' and plate 93 and the series circuit thus formed driven at a high frequency (preferably about 0.6 MHz), Further, an adjustable net potential will be caused across the plasma which can be tuned. The alternating potential applied to plate 93 will cause ions and electrons to be alternately extracted from chamber 91. In conjunction with the AC voltage applied, adjustment of Φ has the effect of a fine adjustment of the relative durations of the periods during which ions and electrons will be respectively extracted from chamber 91 and accelerated toward the target 94 since potential Φ will oscillate relative to $V_p$ and the potential on the target. In this way, a net zero current across the wafer surface can be obtained to avoid charge build-up on the target 94.

When this arrangement is used solely for the purpose of adjusting the mix of charged species it is generally desirable that the filtering action of plate 93 be minimized. Therefore, hole diameter should be large and aperture or "nozzle" length should be as small as possible (and much less than the Debye length). Plural apertures should be provided in an even distribution across plate 93 to obtain a very even pattern of particle distribution in chamber 92. The pressure in the quiescent plasma region (e.g. chamber 92) should be high enough to scatter the thermalized neutral beam and further erase any pattern which may be attributable to the aperture pattern.

Based upon the above teachings, an apparatus 100 for developing a neutral beam of high particle flux will be described in connection with the schematic illustration of FIG. 10. In this variation of the invention, the chamber of apparatus 100 is divided into three sub-chambers. The first sub-chamber 110 is used for plasma pumping as in the apparatus of FIG. 9. AC bias is also applied, as described above, to apertured plate (or "first neutralizer" 113 to adjust the relative electron and ion populations. It should be recognized that roughly equal populations are desirable in second chamber 111 for electric field mediated recombination to proceed efficiently. Plate 113 can have a plurality of apertures, as in the apparatus of FIG. 9 or a single large aperture. A single or small plurality of large apertures may be preferable, depending on the degree on ionization which is achieved (recalling that increased ion population decreases the Debye length) and a lower aperture aspect ratio can be achieved in a plate of adequate thickness (for structural robustness and to withstand pressure differentials thereacross) with larger apertures, particularly where the particle distribution pattern is less critical than in the apparatus of FIG. 9.

Figure 10:
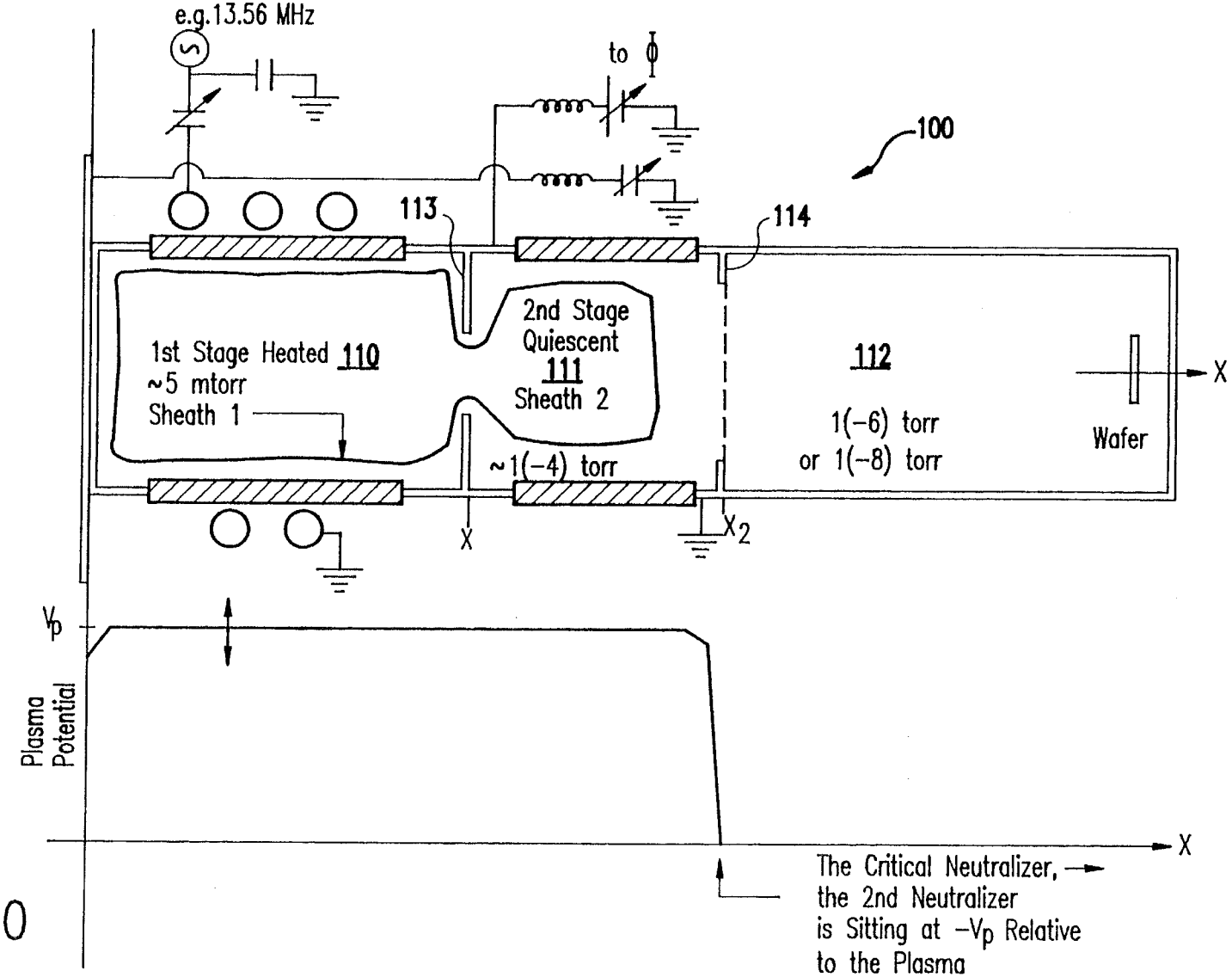
FIG. 10 illustrates a preferred form of the invention for producing a neutral beam of particles for semiconductor processing.

It should also be noted that the first two chambers differ from the apparatus of FIG. 9 by substitution of a "second neutralizer" plate 114 at ground potential (e.g. −Vp relative to the plasma) in FIG. 10 for the target at ground potential in FIG. 9. In this case, both Φ and Vp oscillate relative to the potential on plate 114 and relative accelerations of electrons and ions toward the vicinity of plate 114 is alternately favored by the variation of potential Φ across the plasma to provide roughly equal populations of each at the plasma sheath (of whatever geometry may be determined by the aperture diameter and aspect ratio of apertures in the second neutralizer plate 114. It should also be noted from the graph of potential in the plasma that the second neutralizer plate 114 provides a boundary condition which will cause preferential extraction of particles from the plasma (e.g. filtering) as well as a high degree of neutralization of ions by electric field mediated recombination if the apertures therein are configured as discussed above relative to the Debye length.

Having developed a quiescent plasma in second chamber 111 in much the same manner as described with reference to FIG. 9, particles can be preferentially extracted from the quiescent plasma in the manner described above with reference to FIGS. 5. 7 and 8. Since the degree of ionization in the quiescent plasma is achieved by pumping in the first chamber at a relatively lower vacuum (e.g. preferably about 5 mTorr) than in the second chamber (e.g. preferably about $10^{-4}$ Torr) a high flux is possible regardless of the degree of neutralization which may be achieved. It should be noted that, in accordance with the invention, the degree of neutralization is largely governed by aperture geometry and the relative components of flux are independently determinable for a given degree of ionization (e.g. ion concentration in the plasma). The velocity of the extracted particles is also independently variable with Vp or Φ and, of course, pressure in the third chamber 112 (e.g. preferably about $10^{-6}$ to $10^{-8}$ Torr.

It should also be appreciated from the apparatus of FIG. 10 that the metal boundary provided by the first neutralizer 113 is actively biased to some value $V_p$ above ground such that the second neutralizer is at −Vp relative to the plasma. Neutralization is very efficient when Vp is small and the same as or only slightly exceeding Te in units of electron volts since increases in Te are not sufficient to provide a sufficient population of hot electrons to neutralize high energy ions at the plasma sheath as $V_p$ becomes large in order to increase the degree of ionization. On the other hand, if a second neutralizer in accordance with FIG. 7 is used in the configuration of FIG. 10, a high flux pseudo neutral beam is provided which does not require substantial increase of ion temperature Ti or electron temperature Te. Thus, high flux can be obtained at energies suitable for semiconductor processing.

Figure 11:
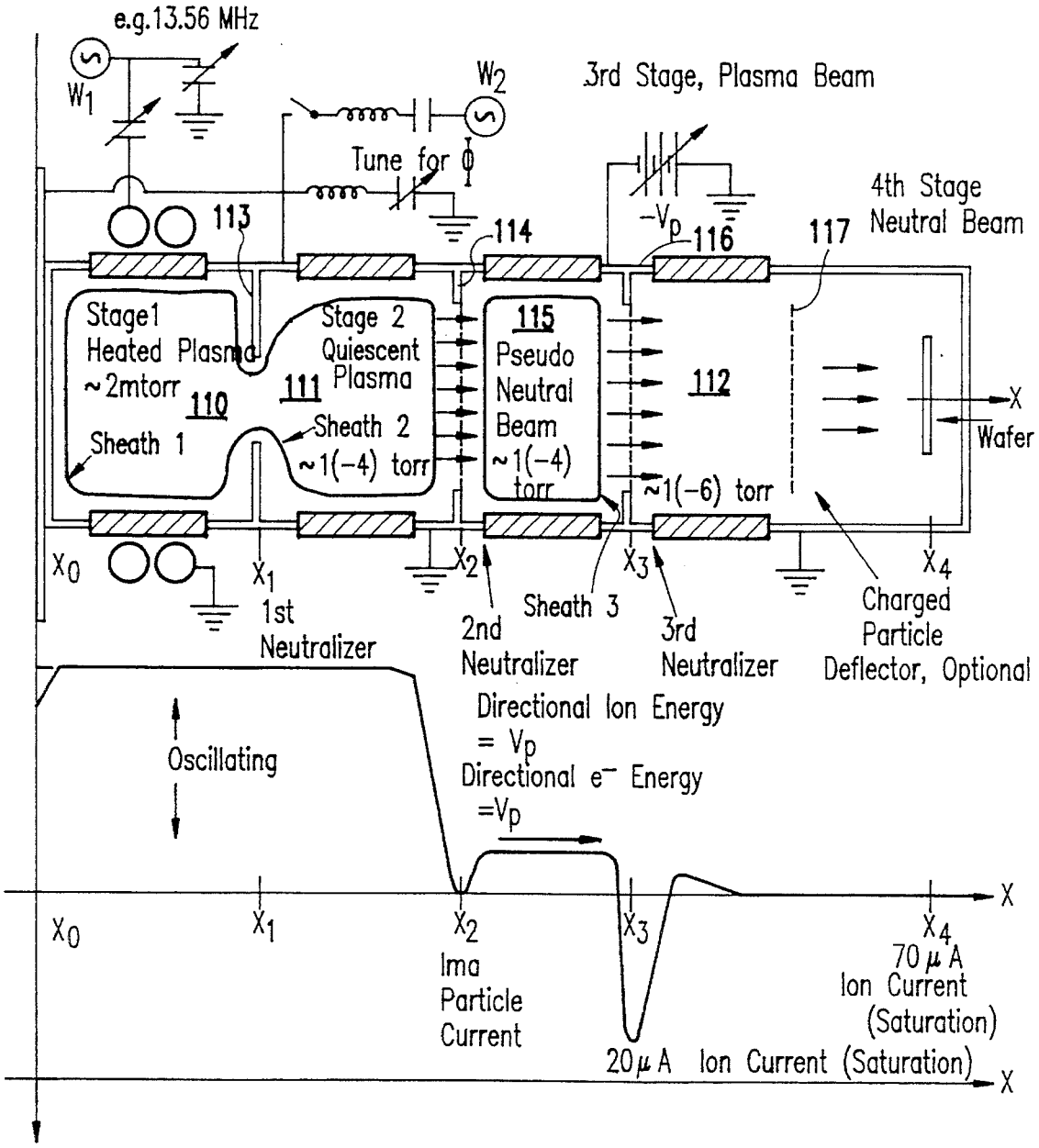
FIG. 11 illustrates a three-stage variation of the preferred form of the invention shown in FIG. 10 having increased efficiency of ion neutralization, FIG. 12 schematically illustrates a preferred form of the invention for in-situ production of hydrofluoric acid.

Such a pseudo neutral beam can also be exploited in the apparatus in accordance with the invention schematically illustrated in FIG. 11. In this application or variation of the invention, chambers 110 and 111 and first and second neutralizer plates 113 and 114 are arranged and electrically biased as in FIG. 10. However, a third chamber 115 is formed by a third neutralizer plate 116 preferably DC biased to about −Vp and chamber 112 becomes a fourth chamber. The third chamber 115, in which the pressure is not critical, provides the sheath electric field for the pseudo neutralized plasma beam or streaming plasma extracted through second neutralizer 114. If third neutralizer plate 116 has apertures configured in accordance with FIG. 8, the final fast neutral particle energy is roughly 2 Vp as shown in the graph of potential at locations over the length of the apparatus. The additional sheath electric fields provided by the apparatus of FIG. 11 thus increase the number of locations where electric field mediated recombination can take place. Experiments indicate that extremely efficient neutralization results from such a configuration. For example, for a 1 mA ion current at the second neutralizer plate 114, an ion current of 20 μA results at the third neutralizer plate and further drops to 70 μnA at the target. The final ion current at the target can be further reduced by a charged particle deflector 117, such as a grid, if desired.

Figure 12:
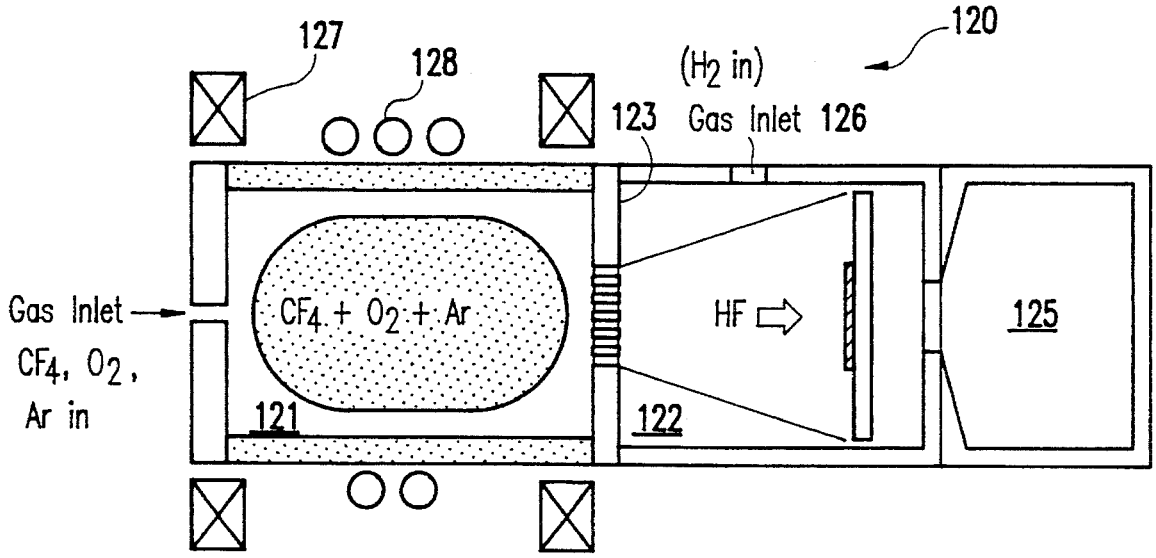

Referring now to FIG. 12, an embodiment of the invention which is specific to the preferred application of the invention will be discussed. As noted above, hydrofluoric acid is a preferred reactant for etching of $SiO_2$ in semiconductor manufacturing and to extremely critical processes referred to as interface tailoring, in particular, while being potentially dangerous if not adequately contained or neutralized after processing is completed. Using this arrangement an effectively "dry", high vacuum compatible process for providing HF by in-situ production is provided.

Figure 8:
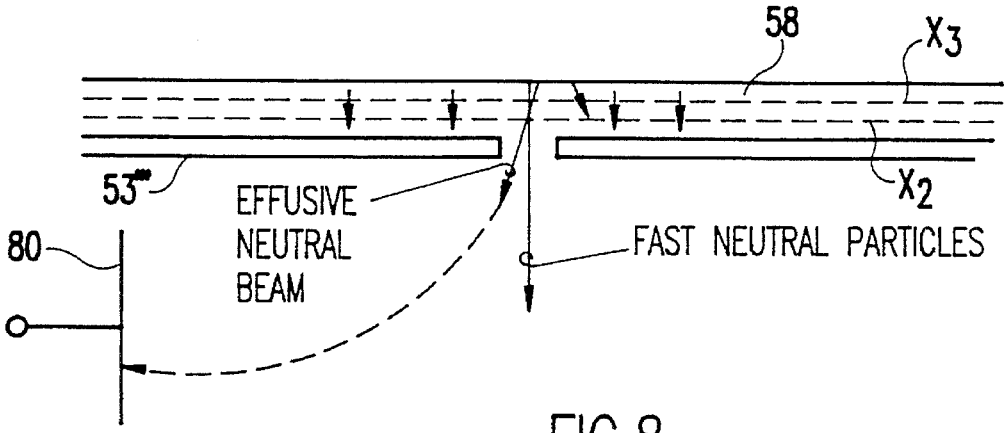
FIG. 8 depicts the geometry of a plasma sheath at a medium aspect ratio aperture having a diameter comparable to the thickness of the plasma sheath in accordance with one aspect of the invention.
Figure 13:
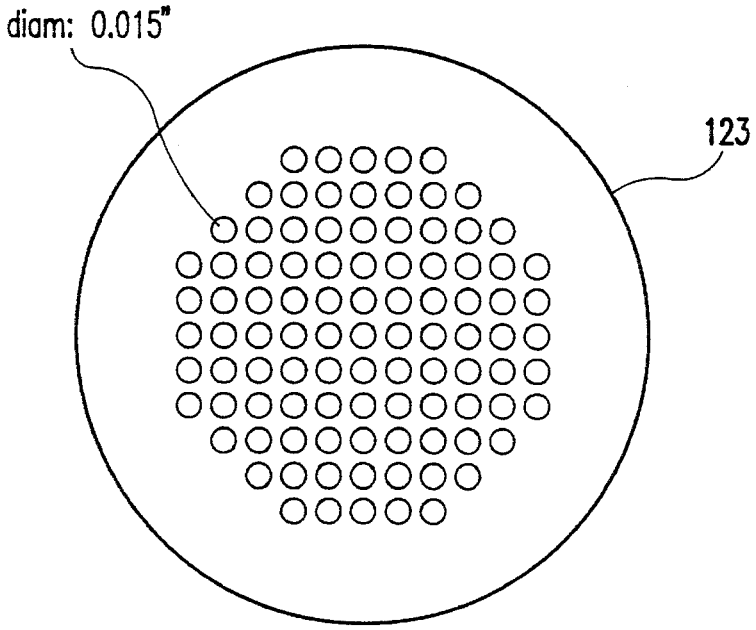
FIG. 13 illustrates a preferred form of apertured plate for use in the apparatus of Figure 12, FIGS. 14 and 15 illustrate the efficacy of the arrangement of FIG. 12 for in-situ production of hydrofluoric acid during an etching process.

The apparatus 120 illustrated in FIG. 12 is similar to that of FIGS. 5 and 9 but neutralizer plate 123, separating chambers 121 and 122 is fabricated in accordance with FIG. 8 to have an array of apertures therein which are not more than a small multiple of the Debye length in diameter and not significantly less than the Debye length (but preferably several times the sheath thickness) in depth through the thickness of the plate. A diameter of 0.015 inches and a depth of 0.062 inches is preferred to provide substantially full neutralization and high directivity of the neutral beam for preferred plasma discharge conditions which will be detailed below. A suitable aperture pattern is shown in FIG. 13. Aluminum is a suitable material for plate 123. Since only gases are preferably used to form the plasma and which preferably have only gaseous reaction products, the geometry of the apertures are not compromised by deposits from the plasma. Even if deposition were to occur on plate 123, a large working "window" could be provided since, in accordance with the discussion of FIG. 8 above, for production of neutral particles reduction of the diameter of apertures or increase in depth does not affect the efficiency of neutralization. Nor does the conductivity of deposits have any effect since there is no net current through plate 123 involved in the neutralization. Any changes in pressure which may affect the process can be compensated by variation of vacuum pumping rates and restriction of the apertures only increases directivity of the neutral beam.

A gas inlet 124 and a vacuum pumping manifold 125 are also included. The apparatus of FIG. 12 also features a second gas inlet 126 opening directly into the second chamber 122. In addition to the coil 128 for RF heating, magnets 127 for assisting in plasma confinement are also preferably provided, although the technique of plasma heating and confinement are not critical to the practice of the invention as long as erosion of surfaces of the apparatus is suitably controlled. A substrate holder is also provided.

For producing HF, appropriate fluorine-containing gases such as $NF_3$ or a mixture of $CF_4$ and $O_2$ are introduced into gas inlet 124 and ionized to form a plasma. Alternatively, plural chambers could be used so that a quiescent plasma exists in the vicinity of plate 123 as discussed above in connection with FIGS. 10 and 11. Hydrogen gas, $H_2$ is introduced through the second gas inlet 126. The pressure of hydrogen gas should be above about $2\times10^{-4}$ Torr (e.g. where the influx of hydrogen gas was roughly equal to the flux through the plate 123) and below a pressure which would destroy the beam (e.g. about 140 mTorr) to destroy the beam through transfer of kinetic energy to the reaction product, HF, and unreacted hydrogen gas molecules and quench the temperature of the HF to temperatures at which etching would not proceed. However, variation of temperature by hydrogen gas pressure could be used to tailor the rate at which etching is done. Thus the etching process is dominated by beam geometry and HF is produced only in the amounts which will react with $SiO_2$ or other material during the etching process.

Therefore, to summarize the operation of the preferred application and embodiment of the invention, by varying power and other discharge parameters and gas flow rate in chamber 121 in accordance with the plasma chemistry which is pursued and providing suitable filtration with plate 123 (and a combination of AC and or DC bias applied thereto, as shown in FIGS. 9–12) and differential pumping, any desired populations of ions, neutral particles and electrons can be achieved by employing the above described principles of the invention. This, in combination with the choice and control of pressure of backfill gases leads to controlled formation of desired reaction products and the delivery of those reaction products to the wafer or other material being processed. This is all performed under high vacuum conditions and accidental release of HF or other reaction products which may be developed is very unlikely. Even if the vacuum is suddenly lost, the only HF which will be present is in the volume of the beam and is likely to react with the wafer or parts of the apparatus before escape into the environment.

In addition to this safety feature of the invention, there are several significant advantages to the plasma chemistry technique provided by the invention. First, by using multiple reaction chambers, the chemistry can be separated into a plurality of locations, each of which is very controllable and the results highly predictable, as distinguished from the uncertainty of plasma chemistry techniques in the past. Just as reactant A from chamber 1 was reacted with reactant B, introduced through gas inlet 126, to form reaction product C, further sequencing by chaining of further chambers can readily be done. For such an arrangement, it is considered desirable to form the apparatus according to any of FIGS. 9–12 in a modular fashion so that single chambers can be assembled into an apparatus specific to a particular desired reaction or reaction product. Further, since the beam geometry dominates reaction product delivery, it is possible to supply several reactants simultaneously by arranging chains of chambers radially or generally hemispherically around a chamber containing the wafer or other material to be treated. Second, since neutralization is highly efficient and, at least in the embodiment of FIG. 12, essentially complete as the particles emerge from the apertures of plate 123, all remaining charged particle may be readily removed from the beam by a simple electrostatic or magnetic deflector arrangement which, of course, will have no effect on the neutral particles in the beam. Thus, electrostatic charging of the wafer and damage from impact of fast ions is substantially avoided since no charged particles will reach it.

Preferred operating condition of the apparatus of FIG. 12 include a 100 W plasma discharge in chamber 1 at approximately $10^{11}/cm^3$ ion density and $10^{13}/cm^3$ gas density in chamber 1 and less than $10^7/cm^3$ plasma density in chamber 2 has resulted in 600 Angstroms $SiO_2$ removal in two hours with no measurable silicon removal even after three hours, corresponding to less than 0.25 angstroms per minute. Incidentally, it was also found that a quartz window used for spectrographically verifying the controlled in-situ production of HF in the apparatus loaded the $SiO_2$ removal rate and even higher differential etch rates are expected.

Figure 14:
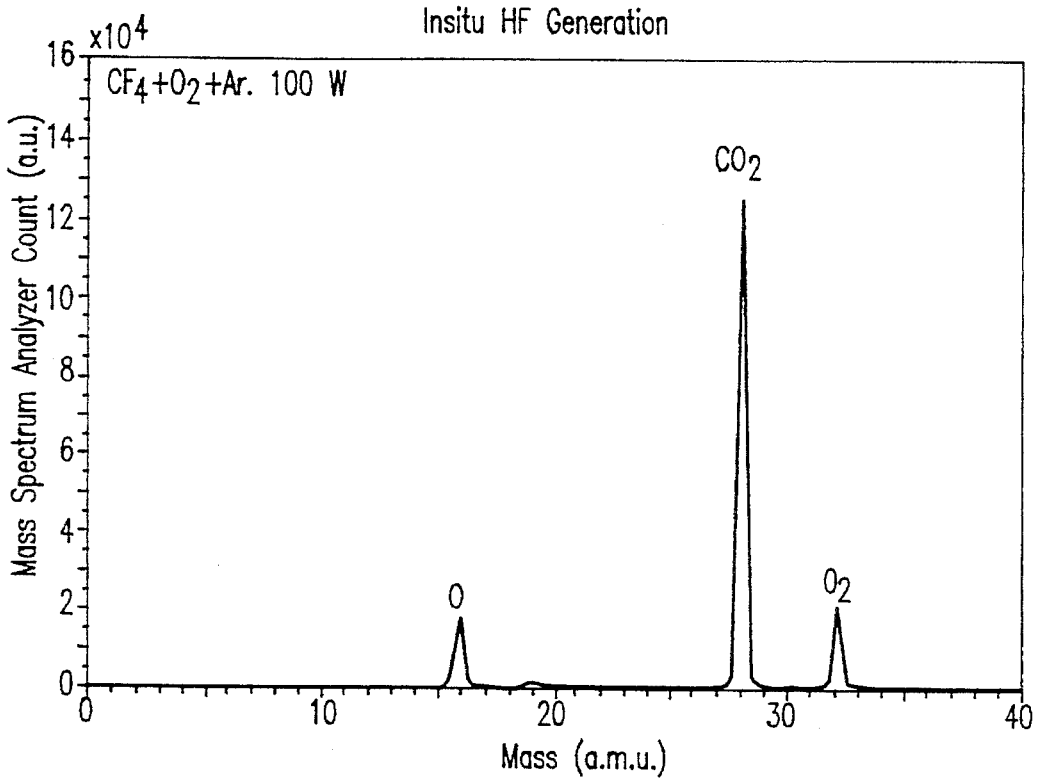
Figure 15:
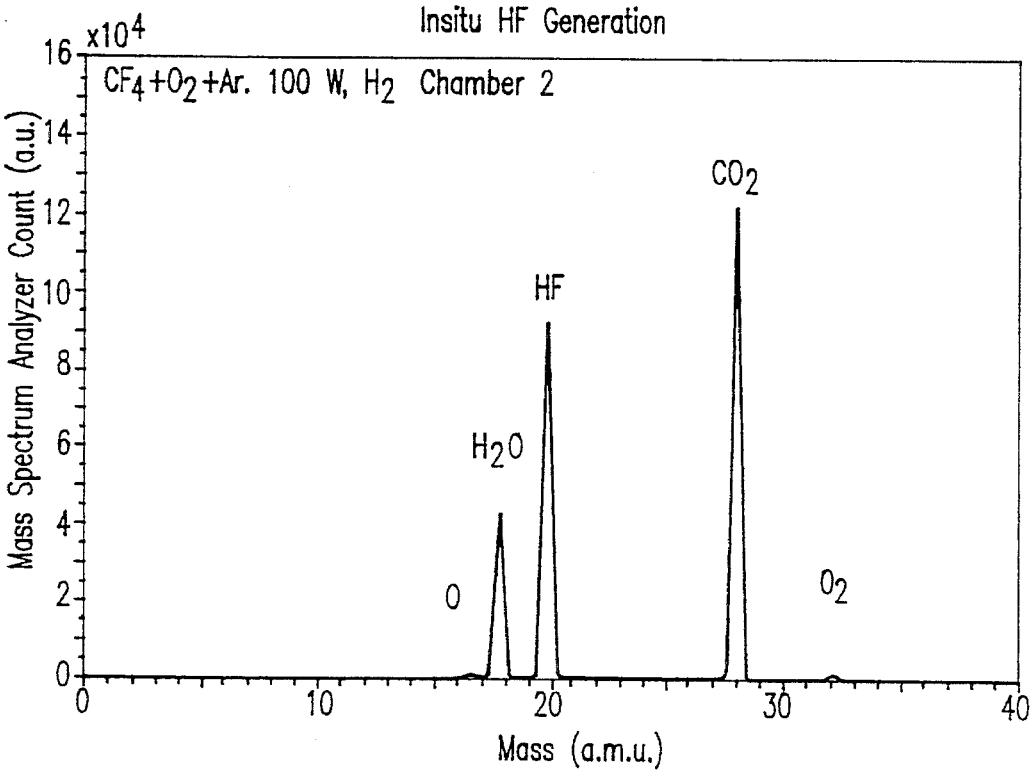

The mass spectra observed in chamber 122 during controlled in-situ production of HF are shown in FIG. 15 and the mass spectra in chamber 122 without the hydrogen gas backfill but production of a plasma from the same fluorine-containing gas mixture ($CF_4$ and $O_2$) is shown in FIG. 14. As can be clearly seen, the peak corresponding to 20 atomic mass units is pronounced and similar to that of $CO_2$ (resulting from the reaction of carbon from $CF_4$ and oxygen) while that peak is entirely absent from FIG. 14 while the O and $O_2$ peaks in FIG. 14 essentially vanish in FIG. 15. Therefore, it can be readily seen that the reaction is extremely controllable through the apparatus and methodology provided by the invention.

It was noted above that erosion of portions of the apparatus and particularly the plasma boundaries due to the plasma temperature, Te, Ti, and the RF pumping required to develop a high percentage of ionization in the plasma by known processes, such as electron cyclotron resonance, can lead to contamination of processed materials in critical semiconductor processing operations. Since the apertured filtering plate must function as a plasma boundary, erosion can increase the diameters of apertures or decrease the effective aspect ratio and otherwise change the shape of the plasma sheath near the apertures, efficiency of neutralization or filtration may be adversely affected. Such erosion also leads to "down time" of the reactor apparatus when renewal or replacement of parts is required. However, high percentage ionization remains generally desirable to maintain higher populations of particles in the beam and higher fluxes to reduce processing time. Further, high percentage ionization increases the quality of the neutral beam.

Accordingly, to provide a plasma source with high percentage ionization at reduced plasma temperatures, inclusion of a submerged design magnetic mirror confined RF inductive magnetron is also a major feature of the invention where both the coil and the dielectric window through which the magnetic field is coupled to the plasma are submerged in a circulating cooling water bath. This design also cools the discharge efficiently and reduces the coil voltage due to the effect of the large dielectric constant of water at RF frequencies since water molecules are highly polarized.

Figure 16:
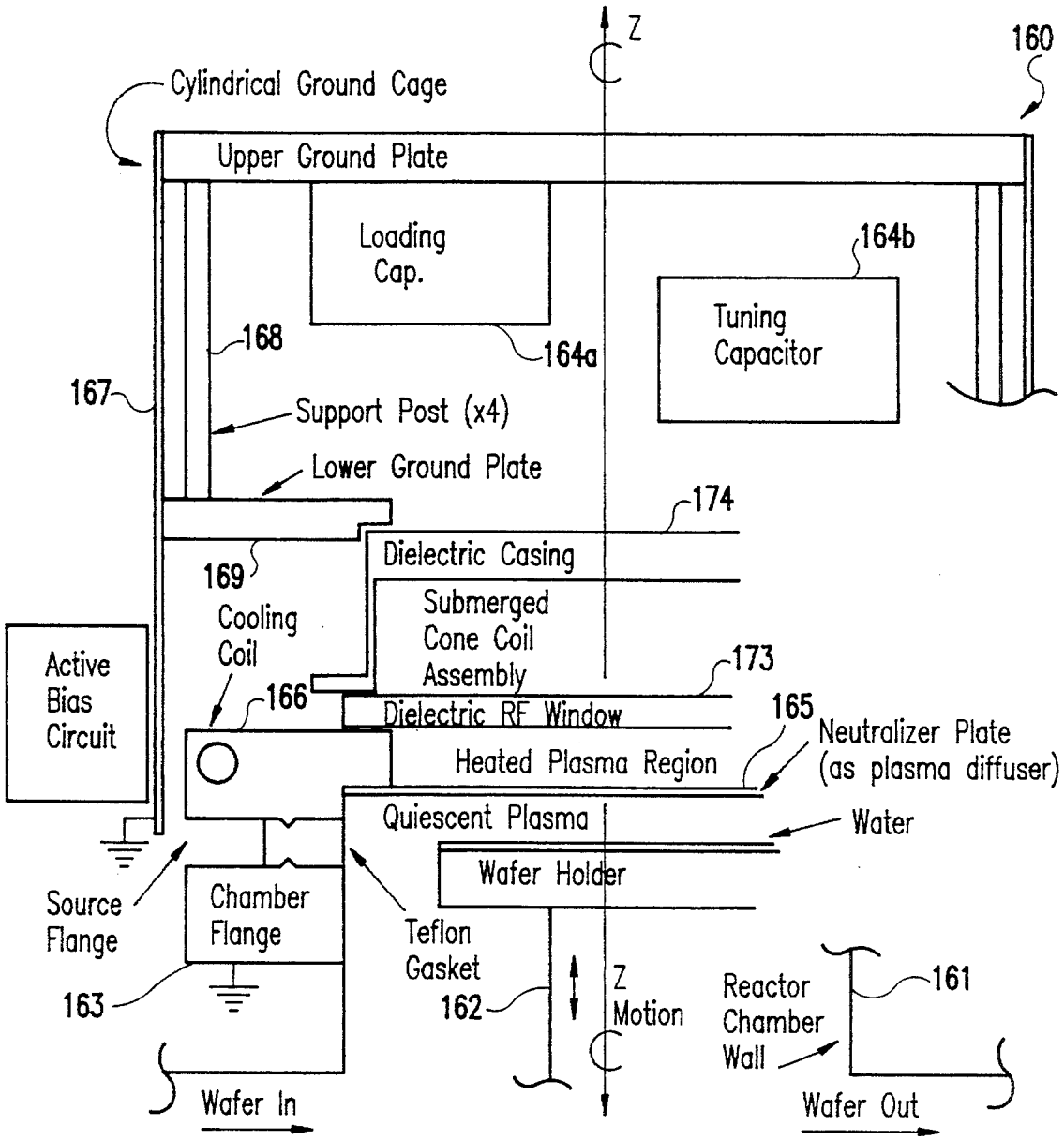
FIGS. 16, 17, 18 and 19 illustrate a preferred structure for producing a neutral beam for application to a semiconductor wafer processing reactor.
Figure 17:
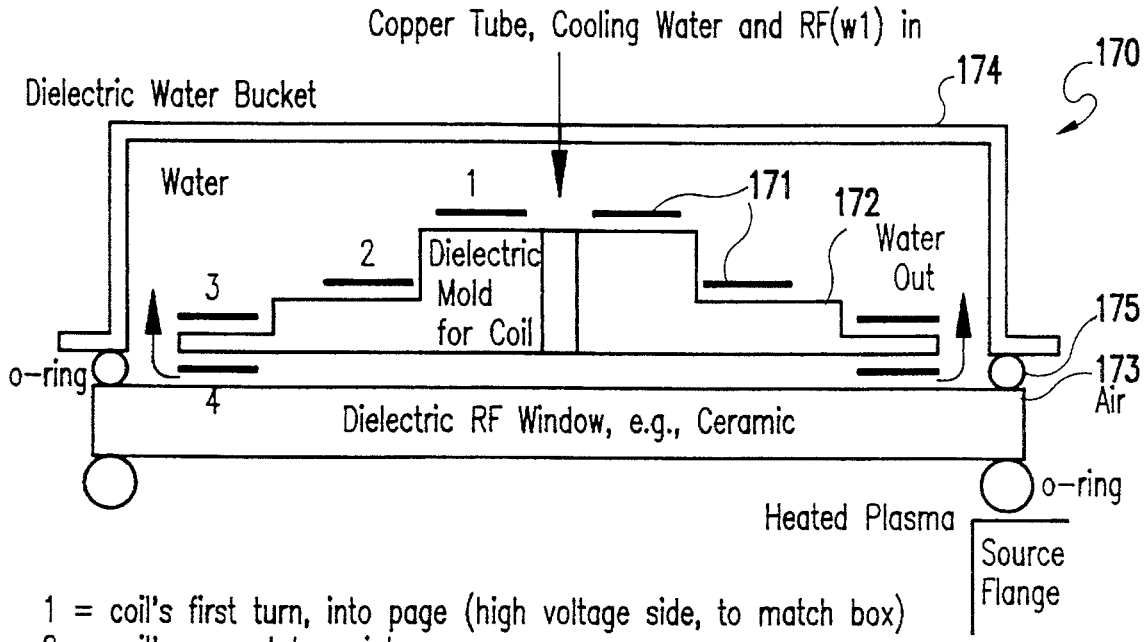

Specifically, FIG. 16 schematically shows an arrangement including a submerged cone coil, preferred for semiconductor processing, in general, and in-situ production of HF, in particular, is coupled to structure which is readily sealable and in which as many chambers as desired together with one or more neutralizer plates can be assembled in a modular fashion. As shown in FIG. 17, a cone coil 170 is used to provide a radially uniform Poynting vector. The shape of the cone is derived by calculating a shape which gives a flat Poynting vector magnitude in a manner well-understood in the art and then fine tuning the shape by taking radial Langmuir probe (L/P) measurements. The turns 171 of the coil, as illustrated in cross-section in FIG. 17 are annular and preferably cut from copper sheet. Four coils are preferred and are mounted on a dielectric (e.g. ceramic) mold 172. The fine tuning of the coil shape can thus be achieved by placing shims between respective coils 171 and the dielectric mold 172. The radial uniformity thus obtained is important to the realization of the best performance of the invention since it allows a uniform plasma to be formed over a substantial area which should ideally be most of the cross-section of the neutral beam apparatus.

More important, however is the arrangement for operating the coils while submerged in a cooling Fluid such as water. This is preferably done by mounting the coil adjacent an RF window 173 through which the magnetic field can emanate and covering the coil with a dielectric water jacket 174 in the shape of an inverted cup. Sealing of the water jacket to the RF window is preferably done by compression of an O-ring 175. The arrangement for compressing the water jacket against the Rf window is of little importance although a preferred arrangement will be discussed below with reference to FIG. 18. Rf power is preferably brought to the coil through a generally central opening in the water jacket, as is the cooling water. The cooling water is preferably directed through the center of the coil and across the RF window between the Rf window 173 and dielectric mold 172. The water then preferably circulates along the periphery of the dielectric water jacket 174 and extracted in a manner not important to the invention. This circulating water cooling of the coil is sufficient that an inexpensive ceramic RF window can be used and the more generally used sapphire RF is not necessary.

The more important advantage of the submerged coil design derives from the polarization of the molecules of the cooling fluid. Water molecules, advantageously, are highly polar and is preferred but other fluids having polar molecules can also be used. At the high frequencies involved in RF induction, such polar molecules cause the fluid to have a high dielectric constant and the magnetic field is, at most, only negligibly affected and erosion of the RF window is eliminated.

Further, since water is a good dielectric at RF frequencies, the coil becomes very efficient. Magnetic flux, for example, can be obtained with much lower voltages applied to the coil. For example, to develop the magnetic flux necessary to adequately pump the plasma for in-situ production of HF, as described above, only a signal of about 45 volts is necessary, compared to about 300 volts for the same cone coil in an air ambient.

The overall structure 160 for in-situ production of HF and interface tailoring of, for example, $SiO_2$ over silicon is schematically shown in cross-section in FIG. 16. It should be understood that this apparatus could be used for numerous other processes, as well. The reaction chamber 161 shown in cut-away form preferably is a housing which also includes a wafer transport mechanism (indicated by arrows labelled "wafer in" and "wafer out") so that a substantial number of wafers can be sequentially processed without opening the chamber. A moveable wafer holder 162, preferably including an electrostatic chuck, is also preferably provided to lift the wafer to a location appropriate to processing from the position to which the wafer is carried by the wafer transport mechanism. A chamber flange, the form of which is unimportant to the invention is preferably provided for attachment of the cone coil assembly 170 and other parts such as driving circuit elements such as loading an tuning capacitors 164*a*, 164*b* and neutralizer plate 165. If a plurality of neutral particle beams are to be simultaneously used, as alluded to above, plural chamber flanges at an angle to each other to aim the respective beams or an adapter plate of that shape to provide such plural flanges may be provided.

A simple and convenient mounting system for implementing the invention includes a multi-purpose source flange 166. The dimensions of the source flange generally correspond to the chamber flange to which it is attached. Sealing between the source flange 166 and the chamber flange 163 is provided by compressing a teflon gasket. The source flange 166 is generally annular and preferably notched at an interior edge to receive the neutralizer plate and carries a cooling coil through which a passage is formed for carrying a circulating cooling fluid. A gas inlet such as 126 of FIG. 12 can be provided through the source flange 166. The source flange 166 is also conductive and of substantial thickness so that, insulated from the grounded reaction chamber by the teflon gasket and insulated from the dielectric RF window by a further compressed O-ring seal, the flange forms the lateral walls of both the first and second chambers 121, 122 of FIG. 12 or a portion thereof and can receive a voltage from an active bias circuit such as that described in connection with FIGS. 9–11. Multiple source flanges may be used and insulated from each other as required to form as many serial chambers as desired for the particular process to be carried out.

A generally cylindrical ground cage 167 preferably in the form of an inverted cup completes the apparatus. The form of this ground cage 167 is not important to the practice of the invention but preferably will provide sufficient interior volume that devices such as loading and tuning capacitors 164*a*, 164*b* can be accommodated in close proximity to the submerged cone coil or other plasma pumping structure. Ground cage 167 also preferably includes an annular plate 169 which rides against the edge of the cone coil water jacket 174 to locate the coil and compress it against the dielectric RF window 173. It the present embodiment, the annular plate is supported by a plurality of support posts 168. Thus, as the water jacket 173 is compressed against the RF window and the RF window is compressed against the source flange by forces transmitted from the ground cage 167, a liquid-air-vacuum seal is formed which is highly effective particularly when the chamber is pumped down to a high vacuum which further compresses the seals.

Figure 18:
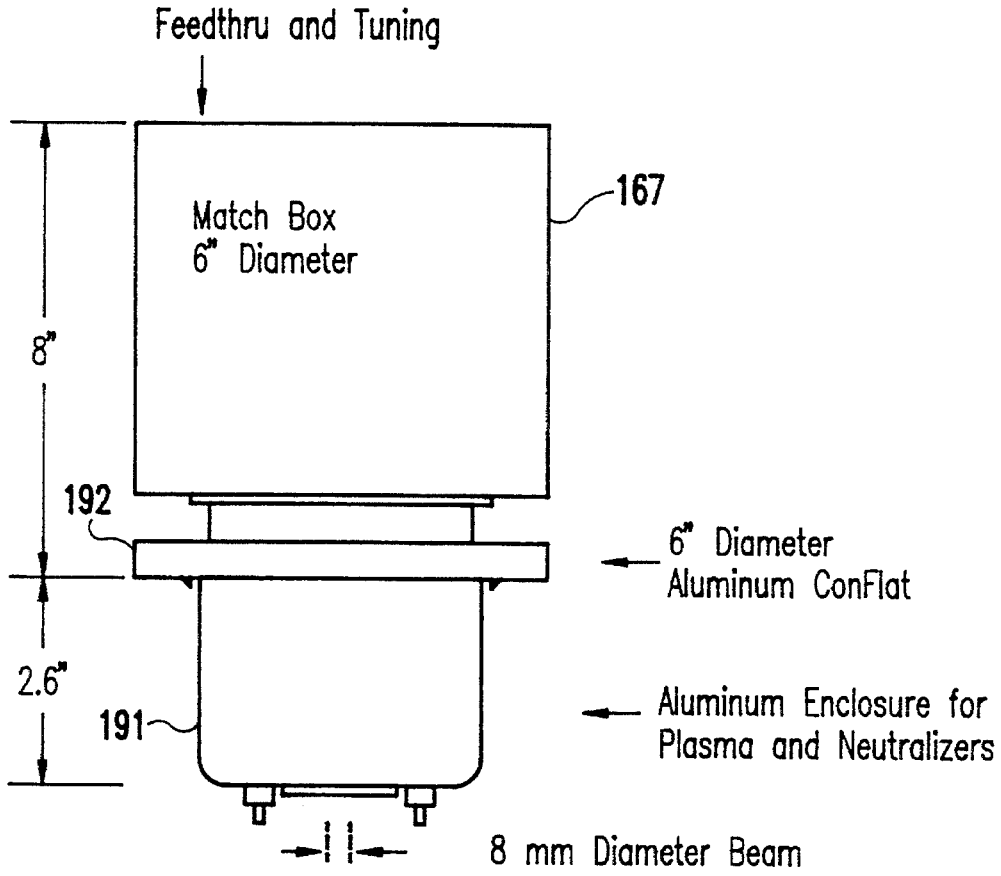
Figure 19:
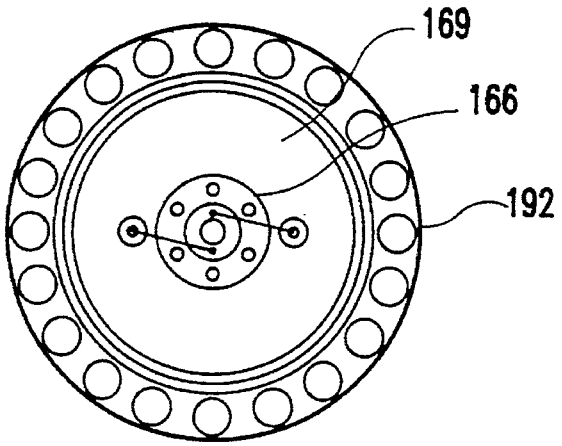

A preferred form of the overall neutral beam source is shown in a side view in FIG. 18 and in an axial view in FIG. 19. In this preferred housing, a sleeve 191 with a separate flange 192 is provided for additional sealing to the reaction chamber 161. Attachment of the ground cage 167 to the sleeve 191 thus provides a sealing compression of the entire assembly when assembled as shown in FIG. 16.

In view of the foregoing, it can be readily appreciated that the invention provides a well-defined beam of neutral particles of relatively high flux, good directivity and geometry and of high quality as to choice of relative populations of species in the beam. The flux and particle energy are readily controllable and scalable from extremely low energies which are suitable for semiconductor processing without damage to the semiconductor crystal lattice and without charging of dielectric structures thereon. The invention provides for control and predictability of plasma chemistry not heretofore available and can form molecular quantities of chemical reactants in-situ at the location where a desired reaction is to occur. In particular regard to interface tailoring and other processes where HF is the reactant of choice, a dry, vacuum compatible process is provided as an alternative to wet processes requiring much greater quantities of reactant.

While the invention has been described in terms of a single preferred embodiment and variations thereon accomplished by modular structures, those skilled in the art will recognize that the invention can be practiced with modification within the spirit and scope of the appended claims.

Having thus described my invention, what we claim as new and desire to secure by Letters Patent is as follows:

1. A method of extracting particles from a plasma through an aperture including the step of regulating the relative populations of ions, electrons, and neutral particles extracted from the plasma in accordance with dimensions of said aperture in combination with at least one of differential vacuum pumping across said aperture and control of ion density in said plasma.

2. A method as recited in claim 1, further including the step of causing a substantially planar plasma boundary in the vicinity of said aperture for enhancement of neutralization.

3. A method as recited in claim 1, including the further step of deflecting charged particles after extraction through said aperture.

4. A method as recited in claim 1, wherein said particles are extracted through a plurality of apertures.

5. A method as recited in claim 1, including the further step of extracting a quiescent plasma region from a heated plasma region, wherein said particles are extracted from said quiescent plasma region.

6. A method as recited in claim 1, wherein said particles extracted from said plasma include ions and electrons.

7. A method as recited in claim 6, wherein extraction of said ions and said electrons are favored during alternating sequential time periods.

8. A method of in-situ formation of a reactant including the steps of extracting ions of a first material and electrons from a plasma, neutralizing a portion of a population of said ions with said electrons by passage through an aperture in a plasma-confining surface to form a neutral beam, and passing said beam through a low pressure gas containing a second material.

9. A method as recited in claim 8, wherein said second material is hydrogen gas.

10. A method as recited in claim 9, wherein said first material is one of $NF_3$ and a mixture of $CF_4$ and $O_2$.

11. An apparatus for producing a beam of neutral particles including means for forming a plasma having a plasma sheath, said plasma sheath having a thickness, and a neutralizer plate having at least one aperture, said aperture having a transverse dimension which is approximately equal to or less than said thickness of said plasma sheath.

12. An apparatus as recited in claim 11, including a further apertured plate.

13. An apparatus as recited in claim 11, including means for applying a bias voltage to said neutralizer plate.

14. An apparatus as recited in claim 13, wherein said bias voltage is an AC voltage.

15. An apparatus as recited in claim 11, including means for applying a bias voltage to said further apertured plate.

16. An apparatus as recited in claim 15, wherein said bias voltage is an AC voltage.

17. An apparatus as recited in claim 11, wherein said means for forming a plasma includes a cone-shaped RF induction coil.

18. An apparatus as recited in claim 17, wherein said cone-shaped induction coil is submerged in a cooling fluid which has a high dielectric constant at high frequencies.

19. An apparatus as recited in claim 18, wherein said cooling fluid is water.

20. An apparatus as recited in claim 11, wherein said neutralizer plate separates a chamber into first and second sub-chambers, said plasma being formed in said first chamber, said apparatus further including means for introducing a gas into said second chamber.

* * * * *